US011548284B2

(12) United States Patent
Munakata et al.

(10) Patent No.: US 11,548,284 B2
(45) Date of Patent: Jan. 10, 2023

(54) METHOD OF MANUFACTURING HEAD CHIP AND HEAD CHIP OF LIQUID JET HEAD

(71) Applicant: SII PRINTER INC., Chiba (JP)

(72) Inventors: Suguru Munakata, Chiba (JP); Daichi Nishikawa, Chiba (JP); Yuzuru Kubota, Chiba (JP); Yuki Yamamura, Chiba (JP); Yuji Nakamura, Chiba (JP)

(73) Assignee: SII PRINTEK INC., Chiba (JP)

( * ) Notice: Subject to any disclaimer, the term of this patent is extended or adjusted under 35 U.S.C. 154(b) by 42 days.

(21) Appl. No.: 17/123,393

(22) Filed: Dec. 16, 2020

(65) Prior Publication Data

US 2021/0187950 A1 Jun. 24, 2021

(30) Foreign Application Priority Data

Dec. 23, 2019 (JP) ..... JP2019-231877

(51) Int. Cl.
*B41J 2/16* (2006.01)

(52) U.S. Cl.
CPC ..... *B41J 2/1634* (2013.01); *B41J 2202/22* (2013.01)

(58) Field of Classification Search
CPC ..... B41J 2/1634; B41J 2202/22; B41J 2/164; B41J 2002/14491; B41J 2/14209; B41J 2002/14362; B41J 2/1609; B41J 2/1632; B41J 2/1623
See application file for complete search history.

(56) References Cited

FOREIGN PATENT DOCUMENTS

| | | | |
|---|---|---|---|
| JP | H11-078001 A | | 3/1999 |
| JP | 2000-108361 A | | 4/2000 |
| JP | 2000108361 A | * | 4/2000 |

OTHER PUBLICATIONS

IP.com search (Year: 2022).*
Extended European Search Report in Europe Application No. 20215922.4, dated May 19, 2021, 10 pages.

* cited by examiner

*Primary Examiner* — Lisa Solomon
(74) *Attorney, Agent, or Firm* — Crowell & Moring LLP

(57) ABSTRACT

Isolation between electrodes is ensured to enhance resistance to a liquid. A conductive film is provided to a surface of a piezoelectric substrate, and laser processing is performed in a groove extending direction on the conductive film between a first groove and a second groove provided to the piezoelectric substrate to thereby form a laser processing area where the conductive film is removed to the surface of the piezoelectric substrate between the first groove and the second groove. In forming the laser processing area, an irradiation operation with a laser is performed along a plurality of laser processing lines extending in the groove extending direction. Further, the irradiation operation with the laser is performed a plurality of times for each of the laser processing lines, and the irradiation operations with the laser performed along the same laser processing line of the plurality of laser processing lines are performed at a time interval from when ending a previous irradiation operation with the laser to when starting a subsequent irradiation operation with the laser.

9 Claims, 20 Drawing Sheets

METHOD OF MANUFACTURING HEAD CHIP AND HEAD CHIP OF LIQUID JET HEAD

RELATED APPLICATIONS

This application claims priority to Japanese Patent Application No. 2019-231877, filed Dec. 23, 2019, the entire content of which is incorporated herein by reference.

BACKGROUND OF THE INVENTION

1. Field of the Invention

The present disclosure relates to a method of manufacturing a head chip and a head chip of a liquid jet head.

2. Description of the Related Art

As a recording device for recording an image, a character, or the like on a recording target medium such as recording paper, there is known a liquid jet recording device equipped with a liquid jet head. The liquid jet head is provided with a head chip, and in the liquid jet recording device equipped with the liquid jet head, a liquid is jetted toward the recording target medium via the head chip, and the image, the character, or the like is recorded on the recording target medium.

The head chip of the liquid jet head is provided with an actuator plate electrically driven when jetting the liquid, and the actuator plate is provided with a plurality of grooves aimed to provide pressure to the liquid as a jet object, and at the same time, inner side surfaces of the plurality of grooves are provided with electrodes.

In JP-A-11-078001, there is disclosed the fact that laser processing is applied to formation of electrode patterns isolated from a conductive film in manufacturing the actuator plate.

In manufacturing the actuator plate, it is desirable to ensure a sufficient distance between the electrodes to which respective voltage different from each other are applied. There is seen a phenomenon that as the number of times of jet operation, namely the number of times of drive of the actuator plate, increases, separation or breakage occurs in a protective film and so on provided to a surface of the actuator plate, and the liquid infiltrates into the protective film and so on. When the infiltration of the liquid progresses, the liquid acts as a bridge to cause short circuit between the electrodes in some cases.

The short circuit between the electrodes can be caused not only by the liquid which infiltrates into the protective film and so on and acts as the bridge, but also by the liquid becoming in the state (e.g., a mist state) in which the liquid can be transmitted through the protective film and so on. Further, there is a tendency that the closer to each other the electrodes adjacent to each other are located, the earlier such short circuit occurs. The fact that the distance should be ensured between the electrodes similarly applies to the manufacture of the actuator plate using the laser processing.

SUMMARY OF THE INVENTION

In one aspect of the present disclosure, there is provided a method of manufacturing a head chip which has an actuator plate, and is adapted to apply pressure to a liquid with the actuator plate so as to jet the liquid. The method of manufacturing the head chip according to the present aspect includes the steps of manufacturing the actuator plate, and joining a nozzle plate having a jet hole for the liquid to a surface of the actuator plate, wherein the step of manufacturing the actuator plate includes the steps of preparing a piezoelectric substrate which has one end and another end at an opposite side to the one end, and has a first groove extending in a groove extending direction from the one end side toward the other end, and communicated with the jet hole, and a second groove extending in the groove extending direction at least at one side of the first groove in a direction crossing the groove extending direction, providing a conductive film to a surface of the piezoelectric substrate, and performing laser processing in the groove extending direction on the conductive film between the first groove and the second groove so as to form a laser processing area where the conductive film is removed to the surface of the piezoelectric substrate between the first groove and the second groove. Further, in the step of forming the laser processing area, an irradiation operation with a laser is performed along a plurality of laser processing lines extending in the groove extending direction, and the irradiation operation with the laser is performed a plurality of times for each of the laser processing lines, and the irradiation operations with the laser performed along the same laser processing line of the plurality of laser processing lines are performed at a time interval from when ending a previous irradiation operation with the laser to when starting a subsequent irradiation operation with the laser.

In another aspect, there is provided a method of manufacturing a head chip which has an actuator plate, and is adapted to apply pressure to a liquid with the actuator plate so as to jet the liquid including the steps of manufacturing the actuator plate, and joining a nozzle plate having a jet hole for the liquid to a surface of the actuator plate, wherein the step of manufacturing the actuator plate includes the steps of preparing a piezoelectric substrate which has one end and another end at an opposite side to the one end, and has a first groove extending in a groove extending direction from the one end side toward the other end, and communicated with the jet hole, and a second groove extending in the groove extending direction at least at one side of the first groove in a direction crossing the groove extending direction, providing a conductive film to a surface of the piezoelectric substrate, and performing laser processing in the groove extending direction on the conductive film between the first groove and the second groove so as to form a laser processing area where the conductive film is removed to the surface of the piezoelectric substrate between the first groove and the second groove, wherein in the step of forming the laser processing area, an irradiation operation with a laser is performed along a plurality of laser processing lines extending in the groove extending direction, the plurality of irradiation operations with the laser are performed so as to provide a distance between the irradiation range with the laser along a first processing line and the irradiation range with the laser along a second processing line different from the first processing line of the plurality of laser processing lines, and a deposition section where a residue after the irradiation operation with the laser is deposited is formed between a first surface of the piezoelectric substrate exposed by the irradiation operation with the laser along the first processing line and a second surface of the piezoelectric substrate exposed by the irradiation operation with the laser along the second processing line.

In still another aspect, there is provided a head chip used in a liquid jet head, the head chip including an actuator plate configured to apply pressure to a liquid, and a nozzle plate which is joined to a surface of the actuator plate, and has a jet hole for the liquid to which the pressure is applied. The actuator plate related to the present aspect is provided with a piezoelectric substrate having one end and another end at an opposite side to the one end, the piezoelectric substrate has a first groove extending in a groove extending direction from the one end side toward the other end, and communicated with the jet hole, and a second groove extending in the groove extending direction at least at one side of the first groove in a direction crossing the groove extending direction, a surface of the piezoelectric substrate is exposed in a laser processing part from which a conductive film provided to the surface is removed by an irradiation operation with a laser, and which extends in the groove extending direction, and is covered with the conductive film in a part other than the laser processing part between the first groove and the second groove, the laser processing part includes a first laser processing part and a second laser processing part separated from the first laser processing part, and the surface of the piezoelectric substrate further has a deposition section where a residue after performing the irradiation operation with the laser is deposited between the first laser processing part and the second laser processing part.

In the present disclosure, it is possible to ensure the distance between the electrode close to the first groove and the electrode close to the second groove to thereby prevent the short circuit due to the liquid acting as a bridge from occurring between these electrodes.

DETAILED DESCRIPTION OF THE PREFERRED EMBODIMENTS

An embodiment of the present disclosure will hereinafter be described in detail with reference to the drawings.

First Embodiment

[Overall Configuration of Printer 1]

Figure 1:
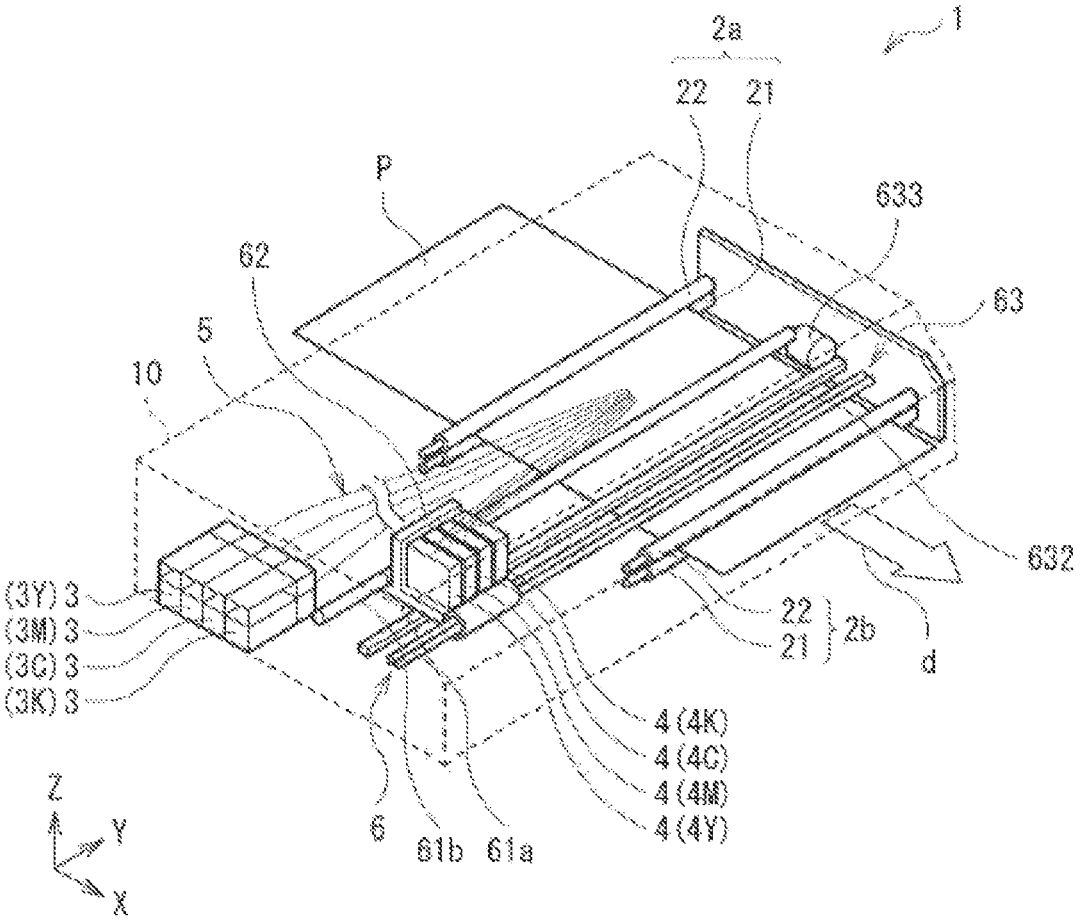
FIG. 1 is a schematic diagram showing a schematic configuration of a liquid jet recording device according to an embodiment of the present disclosure.

FIG. 1 is a schematic diagram showing a schematic configuration of a printer (hereinafter simply referred to as a "printer") 1 as a liquid jet recording device according to a first embodiment of the present disclosure. In FIG. 1, outer edges (contours) of a chassis 10 of the printer 1 are schematically represented by the dotted lines. A liquid jet head according to the first embodiment and a head chip thereof are provided to the printer 1 as a part thereof. The printer 1 is a recording device for recording an image, a character, or the like on a recording target medium, and as the recording target medium on which the recording can be performed by the printer 1, there can be illustrated paper, film, cloth, a tile, and so on.

The printer 1 is an inkjet-type printer for performing recording of images, characters, or the like with ink 9 (FIG. 2) as a liquid on recording paper P as a recording target medium. As shown in FIG. 1, the printer 1 is provided with a pair of carrying mechanisms 2*a*, 2*b*, ink tanks 3, inkjet heads 4, supply tubes 50, and a scanning mechanism 6 in the inside of the chassis 10. Here, in each of the drawings hereinafter referred to, the sizes of the components or the members are arbitrarily changed for the sake of convenience of illustration, and the proportions between the components and so on, or the proportions of the components and so on to the whole of the printer 1 do not accurately represent the actual scale sizes.

The inkjet heads 4 each correspond to a "liquid jet head" according to the first embodiment, and an inkjet head chip 41 described later corresponds to a "head chip" according to the first embodiment.

(Carrying Mechanisms 2*a*, 2*b*)

The carrying mechanisms 2*a*, 2*b* carry the recording paper P loaded on the printer 1 in a carrying direction d (an X direction in FIG. 1). The carrying mechanisms 2*a*, 2*b* are each provided with a grit roller 21 and a pinch roller 22, and at the same time, provided with a drive mechanism not shown. The grit roller 21 and the pinch roller 22 are each disposed so that the rotational axis thereof is parallel to a Y direction (a direction traversing the recording paper P in the width direction thereof, and a direction perpendicular to the carrying direction d of the recording paper P). The drive mechanism is a mechanism for transmitting the power to the grit roller 21 to rotate the grit roller 21 around the axis, namely in a Z-X plane, and is provided with, for example, an electric motor as a power source. In the first embodiment, the electric motor and the grit roller 21 are coupled to each other via an arbitrary power transmission medium.

(Ink Tanks 3)

The ink tanks 3 contain the ink 9 color by color. In the first embodiment, as the ink tanks 3, there are disposed four types of ink tanks 3 (3Y, 3M, 3C, and 3K) for individually containing the ink of a plurality of colors such as four colors of yellow (Y), magenta (M), cyan (C), and black (K). The ink tanks 3Y, 3M, 3C, and 3K are arranged side by side in, for example, the X direction inside the chassis 10. The ink tanks 3Y, 3M, 3C, and 3K all have the same configuration except the color of the ink contained.

(Inkjet Heads 4)

Figure 3:
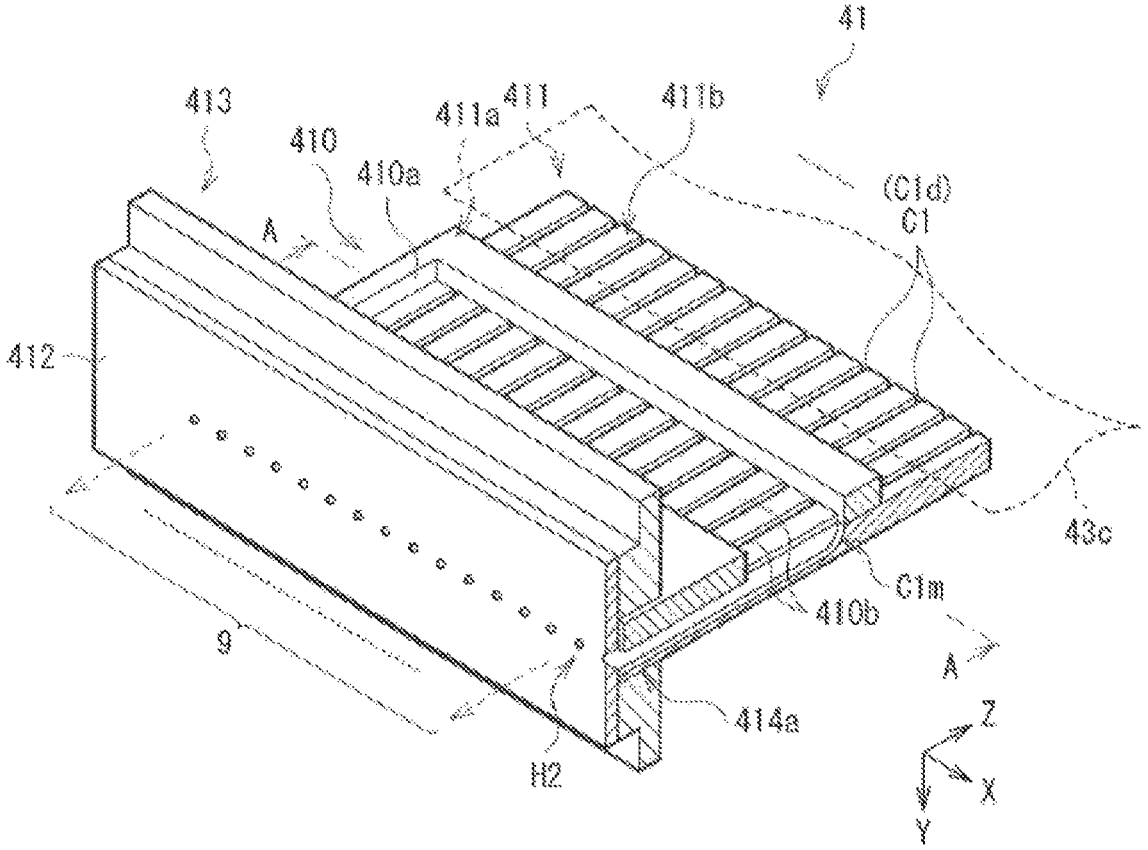
FIG. 3 is a cross-sectional perspective view showing a schematic configuration of a head chip provided to the liquid jet head shown in FIG. 2.

The inkjet heads 4 jet the ink 9 received from the ink tanks 3 via the supply tubes 5 toward the recording paper P as droplets. As described later, the inkjet heads 4 each have a plurality of jet holes H2 opening in a Z direction, and the ink 9 is jetted from each of these jet holes H2 (FIG. 3). In the first embodiment, the inkjet heads 4 are each an edge-shoot type inkjet head, and are each provided with grooves C1 extending in the same direction as the direction of the jet holes H2, and the ink 9 is supplied to the jet holes H2 through the grooves C1. In other words, in the first embodiment, the direction in which the grooves C1 extend and the direction in which the ink 9 is jetted from the jet holes H2 coincide with each other.

(Scanning Mechanism 6)

The scanning mechanism 6 makes the inkjet heads 4 perform a scanning operation in a direction crossing the carrying direction d, in other words, in the width direction of the recording paper P, namely the Y direction. The scanning mechanism 6 is provided with a pair of guide rails 61*a*, 61*b*, a carriage 62, and a drive mechanism 63, wherein the pair of guide rails 61*a*, 61*b* extend in the Y direction, the carriage 62 is supported so as to be able to move on the pair of guide rails 61*a*, 61*b*, and the drive mechanism 63 moves the carriage 62 in the Y direction. The drive mechanism 63 is provided with an electric motor 633 as a power source, and at the same time, provided with an endless belt 632 spanning a pair of pulleys not shown. The carriage 62 is attached to the endless belt 632, and by the power of the electric motor 633 being transmitted to the carriage 62 via the endless belt 632, the carriage 62 moves on the guide rails 61*a*, 61*b* in the Y direction.

In such a manner, in the first embodiment, the scanning mechanism 6 and the carrying mechanisms 2*a*, 2*b* described above move the inkjet heads 4 and the recording paper P relatively to each other in an X-Y plane.

[Configuration of Liquid Jet Heads]

Figure 2:
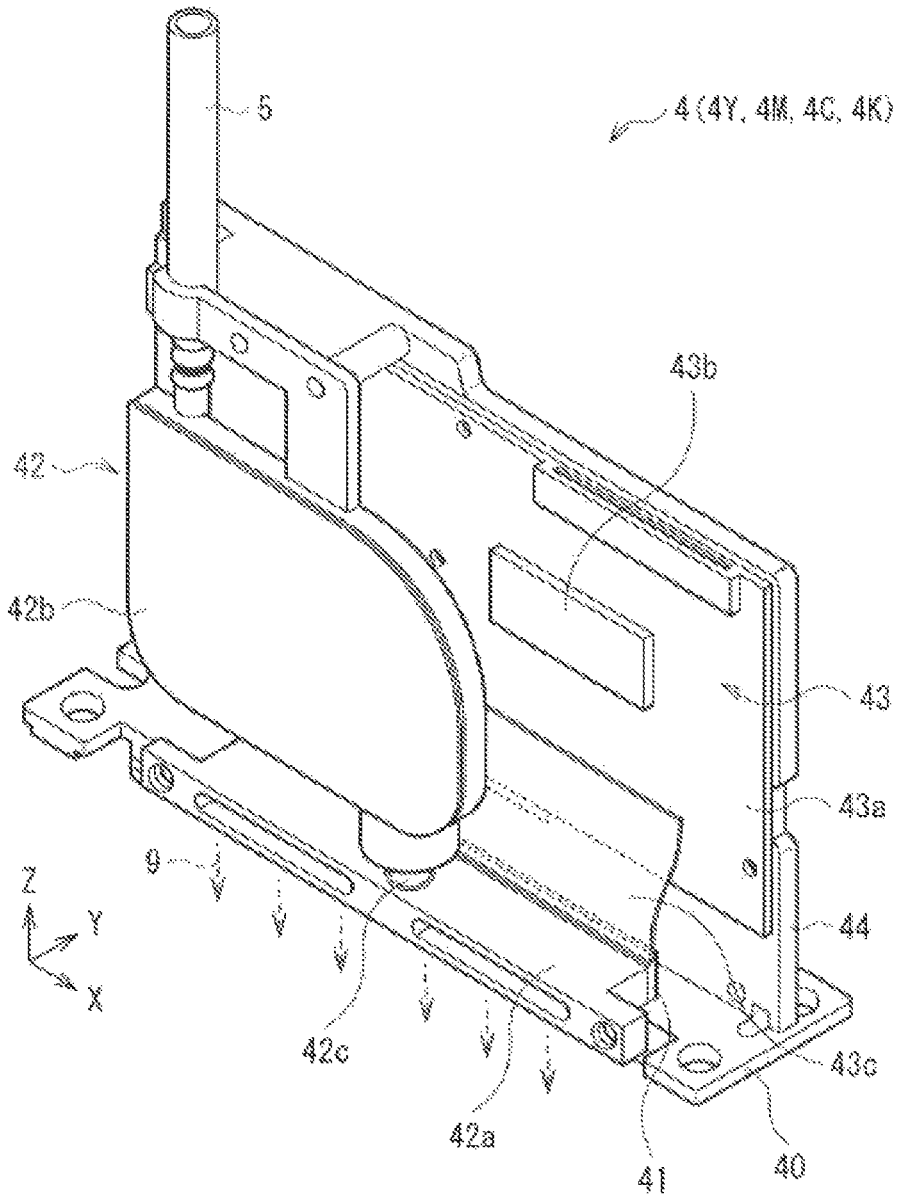
FIG. 2 is a perspective view showing an overall configuration of a liquid jet head provided to the liquid jet recording device shown in FIG. 1.

FIG. 2 is a perspective view showing an overall configuration of each of the inkjet heads 4 (4Y, 4M, 4C, and 4K) provided to the printer 1 shown in FIG. 1.

The inkjet heads 4 are each provided with a fixation plate 40, an inkjet head chip 41, a supply mechanism 42, a control mechanism 43, and a base plate 44. To one surface of the fixation plate 40, there are fixed the inkjet head chip 41, a supply mechanism 42 (specifically a flow channel member 42*a* described later), and the base plate 44. The inkjet head chip 41 corresponds to a "head chip" related to the first embodiment.

(Inkjet Head Chip 41)

The inkjet head chip 41 constitutes a principal part of the inkjet head 4 for jetting the ink 9. The configuration of the inkjet head chip 41 will be described later in detail.

(Supply Mechanism 42)

The supply mechanism 42 supplies the inkjet head chip 41 with the ink 9 supplied via the supply tube 5. The supply mechanism 42 is provided with a flow channel member 42*a* and a pressure buffer 42*b*, and the flow channel member 42*a* and the pressure buffer 42*b* are coupled to each other via an ink coupling tube 42*c*. The flow channel member 42*a* has flow channels through which the ink 9 flows, and the pressure buffer 42*b* is provided with a reservoir chamber of the ink 9, and is attached with the supply tube 5.

(Control Mechanism 43)

The control mechanism 43 is provided with a circuit board 43*a*, a drive circuit 43*b*, and a flexible board 43*c*. The drive circuit 43*b* is a circuit for driving the inkjet head chip 41, and is provided with an integrated circuit and so on, and is incorporated in the circuit board 43*a*. The flexible board 43*c* electrically couples the drive circuit 43*b* and the inkjet head chip 41 (specifically drive electrodes Ed described later) to each other. The flexible board 43*c* is provided with a plurality of terminals coupled to the drive circuit 43*b* and the respective drive electrodes Ed.

[Detailed Configuration of Inkjet Head Chip 41]

Figure 4:
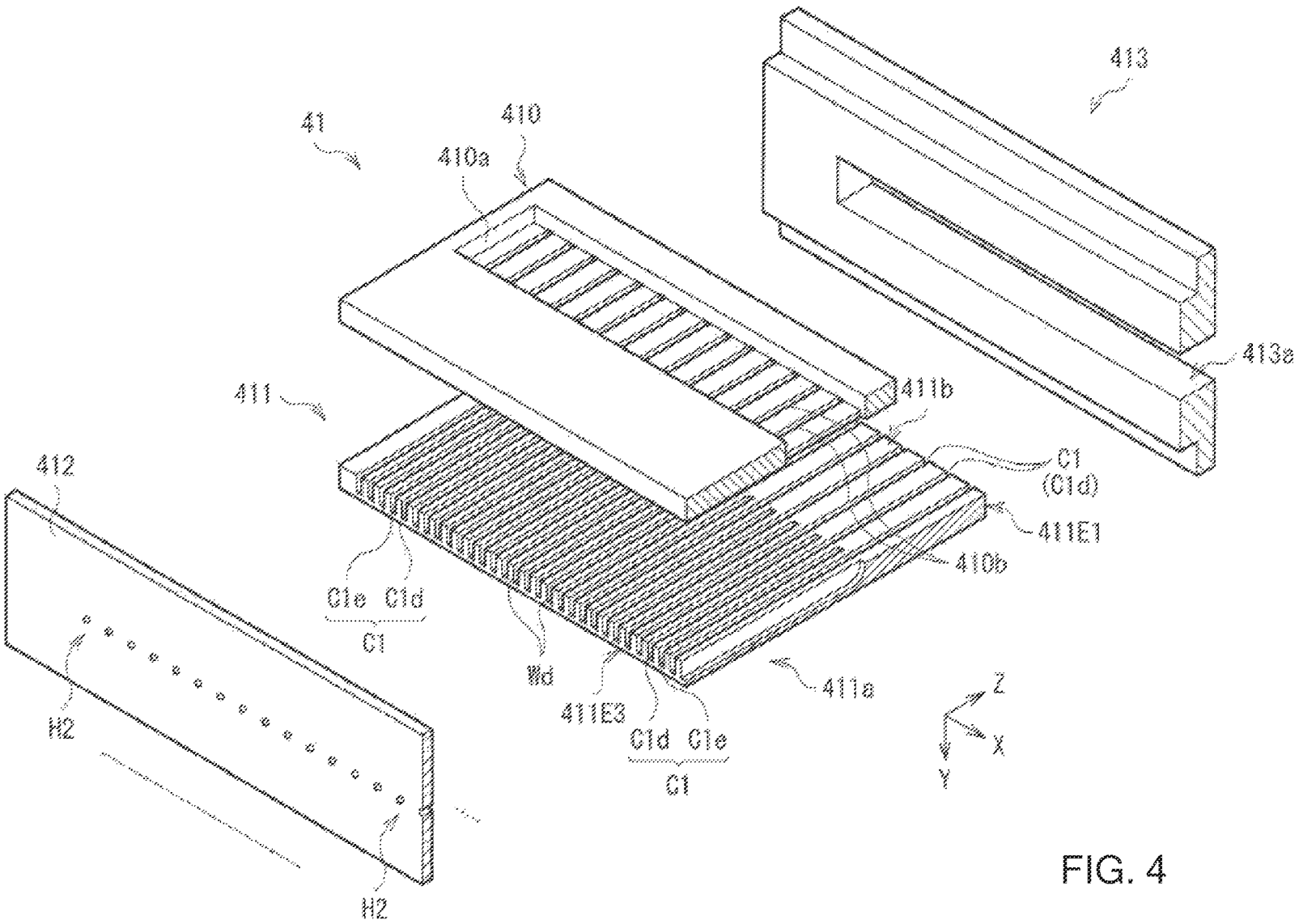
FIG. 4 is an exploded view of the head chip shown in FIG. 3.
Figure 5:
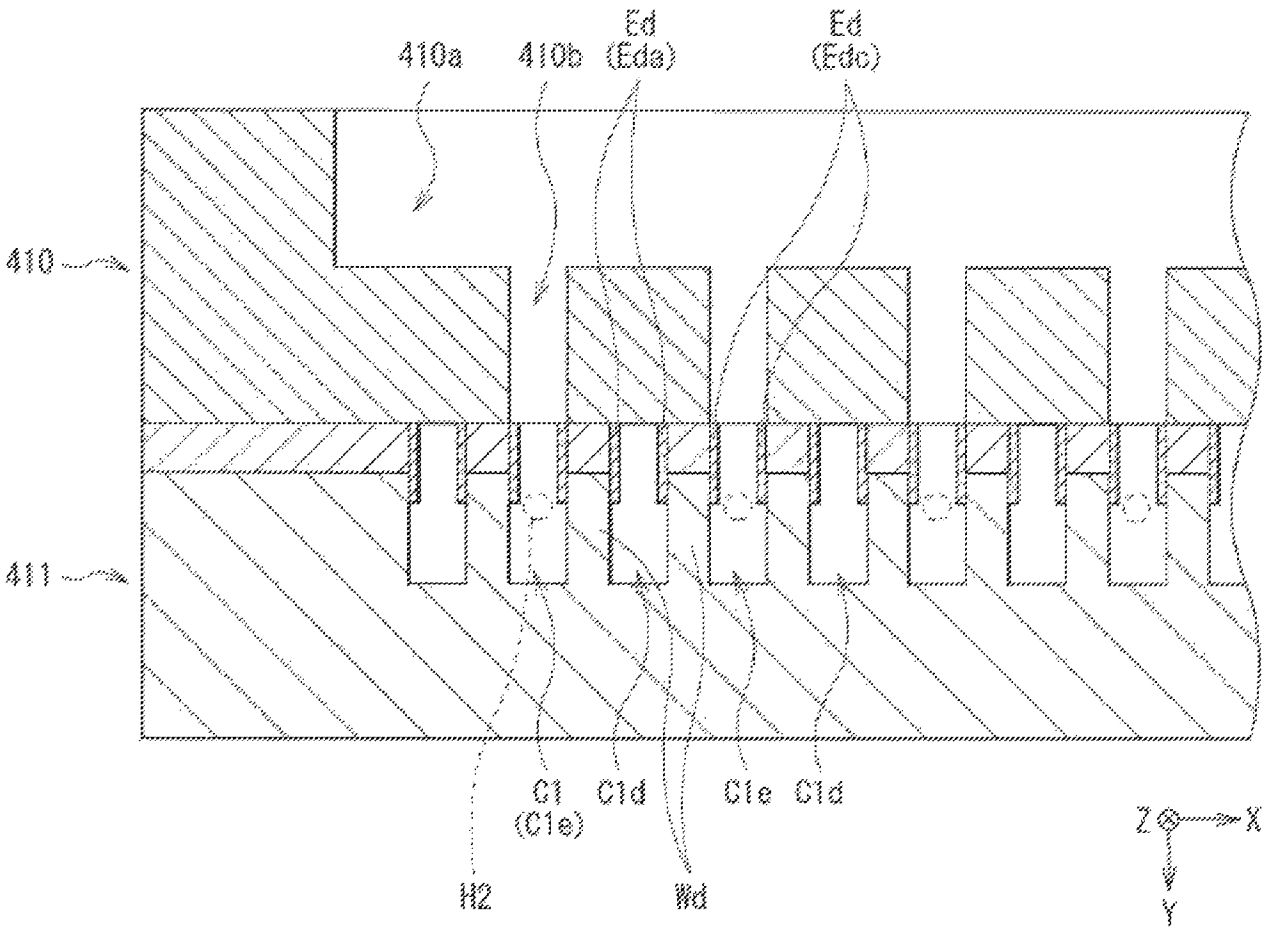
FIG. 5 is a cross-sectional view of the head chip shown in FIG. 3 along the line A-A shown in the drawing, and shows a configuration of an actuator plate and a cover plate.

FIG. 3 is a cross-sectional perspective view showing a schematic configuration of the inkjet head chip 41 provided to the inkjet head 4, and shows the state in which elements constituting the inkjet head chip 41 are combined with each other. FIG. 4 is an exploded view of the inkjet head chip 41, and shows the state in which the inkjet head chip 41 is broken down into constituents to be separated from each other. FIG. 5 is a cross-sectional view of the inkjet head chip 41 along the line A-A shown in FIG. 3, and the plurality of jet holes H2 is represented by the dotted lines. In FIG. 3, the contour of a part of the flexible board 43*c* is represented by the dotted line.

The inkjet head chip 41 is provided with a cover plate 410, an actuator plate 411, a nozzle plate 412, and a base plate 413 as shown in FIG. 3 and FIG. 4. The cover plate 410 and the actuator plate 411 are stacked on one another. The base plate 413 is made to have contact with the nozzle plate 412 in the state in which the cover plate 410 and the actuator plate 411 are fitted into a fitting hole 413*a* (FIG. 4) of the base plate 413.

The cover plate 410 is bonded to the actuator plate 411 with an adhesive. The nozzle plate 412 is joined to end parts of the cover plate 410 and the actuator plate 411 in the Z direction with an adhesive.

(Actuator Plate)

The actuator plate 411 is a member to be electrically driven when jetting the ink 9 from the plurality of nozzle holes H2 provided to the nozzle plate 412.

The actuator plate 411 is provided with a plurality of drive walls Wd for defining the plurality of grooves C1 parallel to each other.

The actuator plate 411 is a plate formed of a piezoelectric material such as PZT (lead zirconate titanate). The actuator plate 411 has a rectangular planar shape, one side thereof is provided with an end part 411E1 of the actuator plate 411, and a side opposed to the side provided with the end part 411E1 is provided with an end part 411E3 (FIG. 4). Further, the flexible board 43*c* is coupled in the vicinity of the end part 411E1, and the end part 411E3 is bonded to the nozzle plate 412. The end part 411E1 corresponds to "one end" related to the first embodiment, and the end part 411E3 corresponds to the "other end" related to the first embodiment.

As shown in FIG. 4, the actuator plate 411 is a so-called chevron type actuator plate formed by stacking two piezoelectric substrates different in polarization direction from each other on one another along the thickness direction (the Z direction). The actuator plate 411 is not limited to the above, but can be a so-called cantilever type or monopole type actuator plate formed of a single piezoelectric substrate having the polarization direction set to one direction along the thickness direction (the Z direction). The grooves C1 are each a non-penetrating groove having a bottom surface, and include a plurality of ejection grooves C1*e* and a plurality of non-ejection grooves C1*d*. The ejection grooves Cle and the non-ejection grooves C1*d* are alternately arranged in the X direction. Among the ejection grooves C1*e* and the non-ejection grooves C1*d*, only the ejection grooves C1*e* are communicated with the jet holes H2 (the jet holes H2 are represented by the dotted lines in FIG. 5), and each function as a pressure chamber for applying pressure to the ink 9 when jetting the ink 9. In other words, the actuator plate 411 is provided with a structure in which the ejection grooves C1*e* are filled with the ink 9 on the one hand, but the non-ejection grooves C1*d* are not filled with the ink 9 on the other hand. Further, as shown in FIG. 5, the ejection grooves C1*e* are communicated with an ink introduction hole 410*a* of the cover plate 410 on the one hand, but the non-ejection grooves C1*d* are not communicated with the ink introduction hole 410*a* but are covered with the cover plate 410 from above to thereby be closed on the other hand.

Each of the grooves C1 extends in the Z direction along a groove extending direction from the end part 411E3 of the actuator plate 411 toward the end part 411E1 thereof. It should be noted that the non-ejection grooves Cid each extend throughout the whole of the actuator plate 411 in the groove extending direction from the end part 411E3 up to the end part 411E1 while the ejection grooves C1*e* each reach the end part 411E3, but fail to reach the end part 411E1, and end at a position between the end part 411E3 and the end part 411E1. In other words, the length in the groove extending direction (the Z direction in the first embodiment) of the ejection grooves C1*e* is shorter than the length in the same direction of the non-ejection grooves C1*d*. Here, the ejection grooves C1*e* each correspond to a "first groove" related to the first embodiment, and the non-ejection grooves C1*d* each correspond to a "second groove" related to the first embodiment.

Further, an inner wall surface C1*m* for defining a dead end in the Z direction of the ejection groove C1*e* rises so as to get away from the nozzle plate 412 as coming closer to the opening from the bottom surface.

Further, in the first embodiment, the actuator plate 411 has a first channel forming portion 411*a* provided with both of the ejection grooves C1*e* and the non-ejection grooves C1*d* in a region close to the end part 411E3. On the other hand, the actuator plate 411 has a second channel forming portion 411*b* provided only with the non-ejection grooves C1*d* out of the ejection grooves C1*e* and the non-ejection grooves C1*d* in a region close to the end part 411E1. The plurality of drive walls Wd described above is for defining both of the ejection grooves C1*e* and the non-ejection grooves C1*d*, and is disposed in the first channel forming portion 411*a*.

As shown in FIG. 5, the inner side surface of each of the drive walls Wd is provided with the drive electrode Ed extending in the Z direction. The drive electrode Ed is an electrode for electrically deforming the drive wall Wd in order to make the ejection groove C1*e* function as the pressure chamber.

The drive electrodes Ed include pairs of common electrodes Edc disposed on the inner side surfaces of the drive walls Wd for defining the ejection grooves C1*e*, and pairs of active electrodes Eda disposed on the inner side surfaces of the drive walls Wd for defining the non-ejection grooves Cid. The active electrodes Eda and the common electrodes Edc each extend to an intermediate point of the inner wall surface toward an interface between the cover plate 410 and the actuator plate 411, in other words, from the surface of the actuator plate 411 toward the bottom part of the groove C1. The active electrodes Eda and the common electrodes Edc each extend to a deeper position (i.e., a farther position than a boundary (a junction surface) between two piezoelectric substrates different in polarization direction from each other in the Y direction shown in FIG. 5) than the boundary. In FIG. 3 and FIG. 4, illustration of the drive electrodes Ed is omitted for the sake of convenience.

Figure 9:
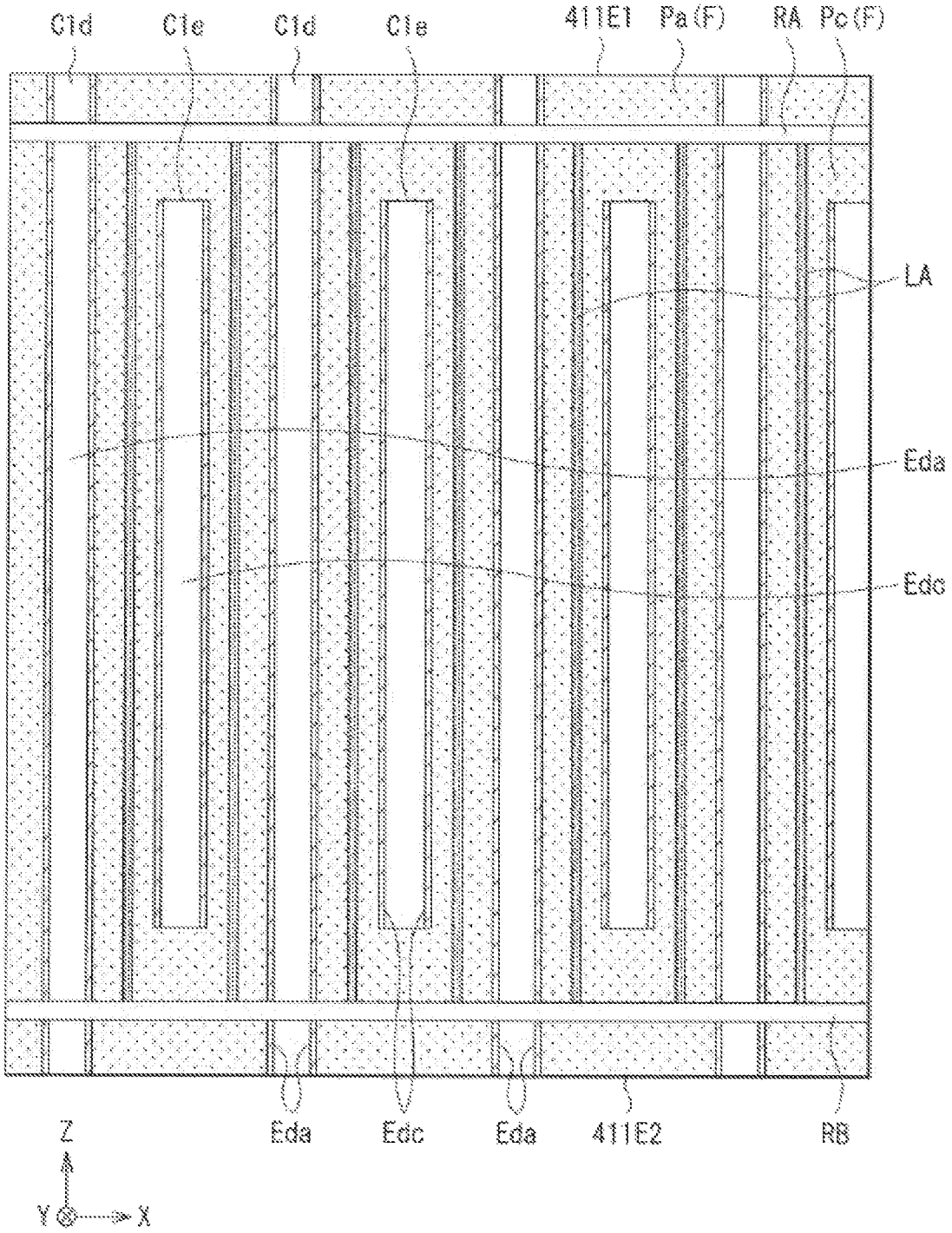
FIG. 9 is a plan view for explaining a surface removal process shown in FIG. 6.

On the opposite surface (hereinafter referred to as a surface of the actuator plate 411) of the actuator plate 411 to the cover plate 410, there are disposed a plurality of common electrode pads Pc electrically coupled to the common electrodes Edc, respectively, and a plurality of active electrode pads Pa electrically coupled to the active electrodes Eda, respectively. It should be noted that the plurality of common electrode pads Pc and the plurality of active electrode pads Pa are illustrated in FIG. 9 described later. In each of FIG. 3 and FIG. 4, illustration of the plurality of common electrode pads Pc and the plurality of active electrode pads Pa is omitted.

The common electrode pads Pc (FIG. 9) are each for electrically coupling the pair of common electrodes Edc, Edc opposed to each other in the same ejection groove C1*e* to each other, and are each disposed on the periphery of the ejection groove C1*e* in the surface of the actuator plate 411.

The pair of active electrodes Eda, Eda opposed to each other in the same non-ejection groove C1*d* are electrically separated from each other. The active electrode pads Pa are each for electrically coupling the pair of active electrodes Eda located at both sides across the ejection groove C1*e* to each other. The active electrode pads Pa are disposed between the non-ejection grooves C1*d*, C1*d* adjacent to each other across the ejection groove C1*e*, disposed so as to electrically be separated from the common electrode pads Pc, and disposed at positions closer to the end part 411E1 than the common electrode pads Pc.

As is understood from FIG. 3, the common electrode pads Pc and the active electrode pads Pa are exposed from the cover plate 410, and the flexible board 43*c* is coupled to the common electrode pads Pc and the active electrode pads Pa. In the first embodiment, interconnection patterns provided to the flexible board 43*c* are electrically coupled respectively to the common electrode pads Pc and the active electrode pads Pa. Thus, it is possible to apply the drive voltage to the drive electrodes Ed from the drive circuit 43*b* via the flexible board 43*c*.

In the first embodiment, the drive voltages different in polarity from each other are respectively applied to the common electrode Edc and the active electrode Eda. For example, the ground voltage is applied to the common electrode Edc, and a positive potential is applied to the active electrode Eda. It is possible to apply a negative voltage to the common electrode Edc.

(Cover Plate)

The cover plate 410 is a member which is disposed so as to be opposed to the actuator plate 411, and covers the actuator plate 411. Specifically, as shown in FIG. 3 through FIG. 5, the cover plate 410 is provided with a plurality of slits 410*b*, and has an ink introduction hole 410*a* having a recessed shape communicated with each of the slits 410*b*. The slits 410*b* each extend in a direction parallel to the groove extending direction (the Z direction), and penetrate in the thickness direction of the cover plate 410. The positions of the slits 410*b* respectively correspond to the positions of the ejection grooves C1*e*, and the ink introduction hole 410*a* is communicated with the ejection grooves C1*e* via the respective slits 410*b*. Thus, the ink 9 is supplied to the ejection grooves C1*e* from the ink introduction hole 410*a* via the respective slits 410*b*, and each of the ejection grooves C1*e* is filled with the ink 9.

(Nozzle Plate)

The nozzle plate 412 has the plurality of jet holes H2, and makes contact with the end part 411E3 of the actuator plate 411. The plurality of jet holes H2 is arranged at intervals in the X direction, and the opening shape of the jet hole H2, namely the shape of the jet hole H2 viewed in the Z direction from the front in the jet direction is, for example, a circular shape. Further, the jet hole H2 is provided with a taper with a narrow tip, and the inner diameter thereof gradually decreases in the direction in which the ink 9 is jetted. The nozzle plate 412 can be formed including any one species or two or more species of insulating materials such as polyimide. Further, it is also possible for the nozzle plate 412 to include any one species or two or more species of electrically conductive materials such as stainless steel (SUS).

(Base Plate)

The base plate 413 has the fitting hole 413*a* extending in the X direction, and the cover plate 410 and the actuator plate 411 are fitted into the fitting hole 413*a* in the state of being stacked on one another.

[Manufacturing Process of Inkjet Head 4 (Inkjet Head Chip 41)]

Figure 6:
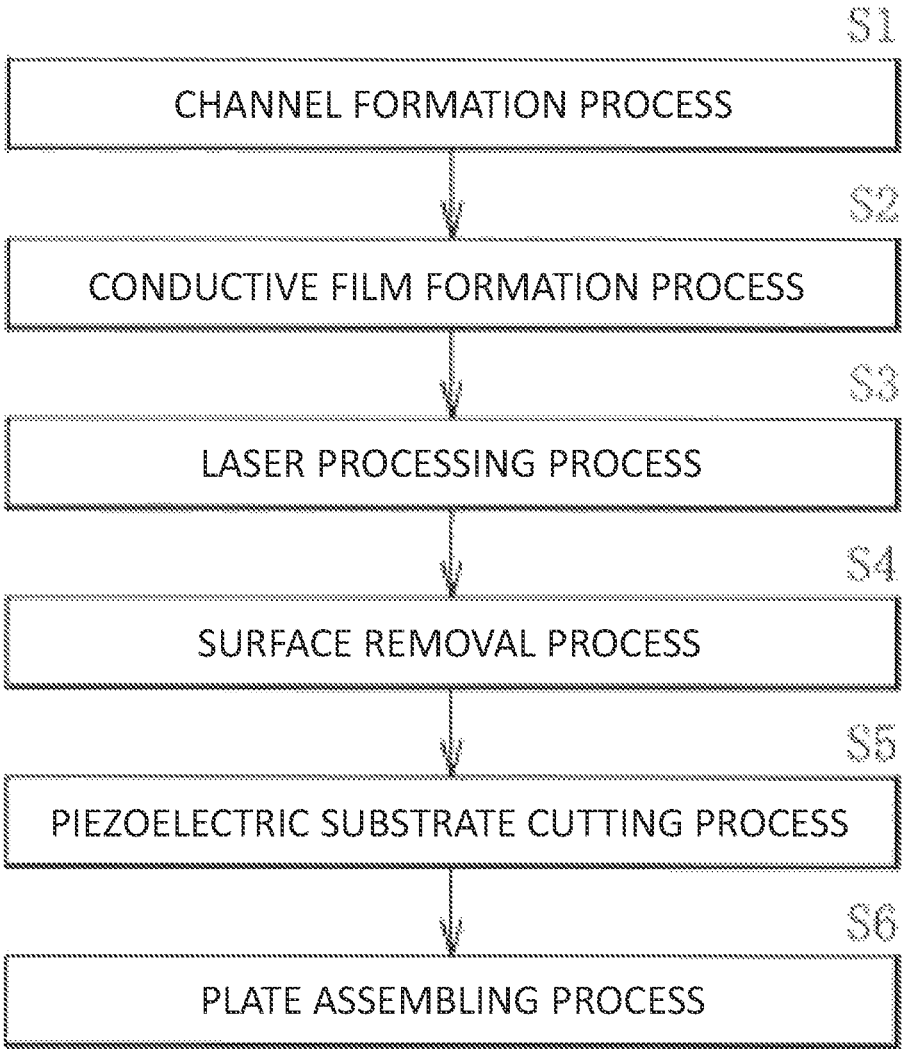
FIG. 6 is a flowchart showing an overall flow of a manufacturing process of the liquid jet head according to an embodiment of the present disclosure.

The manufacturing process of the inkjet head 4 according to the first embodiment will be described with reference to FIG. 6 through FIG. 15. FIG. 6 shows the manufacturing process of the inkjet head 4 according to the first embodiment in the process order. FIG. 7 through FIG. 10 are schematic diagrams for explaining the steps S2 through S5 in the flowchart shown in FIG. 6 process by process. FIG. 11 through FIG. 15 relate to the laser processing process in the step S3 shown in FIG. 6, and show a laser processing area and an irradiation sequence with the laser when forming the laser processing area.

First, a piezoelectric substrate (a piezoelectric substrate 411Z shown in FIG. 7 and FIG. 8) made of a piezoelectric material such as PZT is prepared. The piezoelectric substrate 411Z is configured as a stacked body of two piezoelectric substrates different in polarization direction from each other, and has a rectangular planar shape. One side of the piezoelectric substrate 411Z forms the end part 411E1 of the actuator plate 411. A side opposed to the side corresponding to the end part 411E1 forms an end part 411E2. The end part 411E3 (FIG. 4) of the actuator plate 411 is formed between the end part 411E1 and the end part 411E2.

Subsequently, in the step S1, the grooves C1 (the ejection grooves C1*e* and the non-ejection grooves C1*d*) are provided to the surface of the piezoelectric substrate 411Z. The formation of the grooves C1 can be achieved by performing a groove processing on the surface of the piezoelectric substrate 411Z using a dicer. The grooves C1 are formed along the groove extending direction from the end part 411E1 side toward the end part 411E2.

Figure 7:
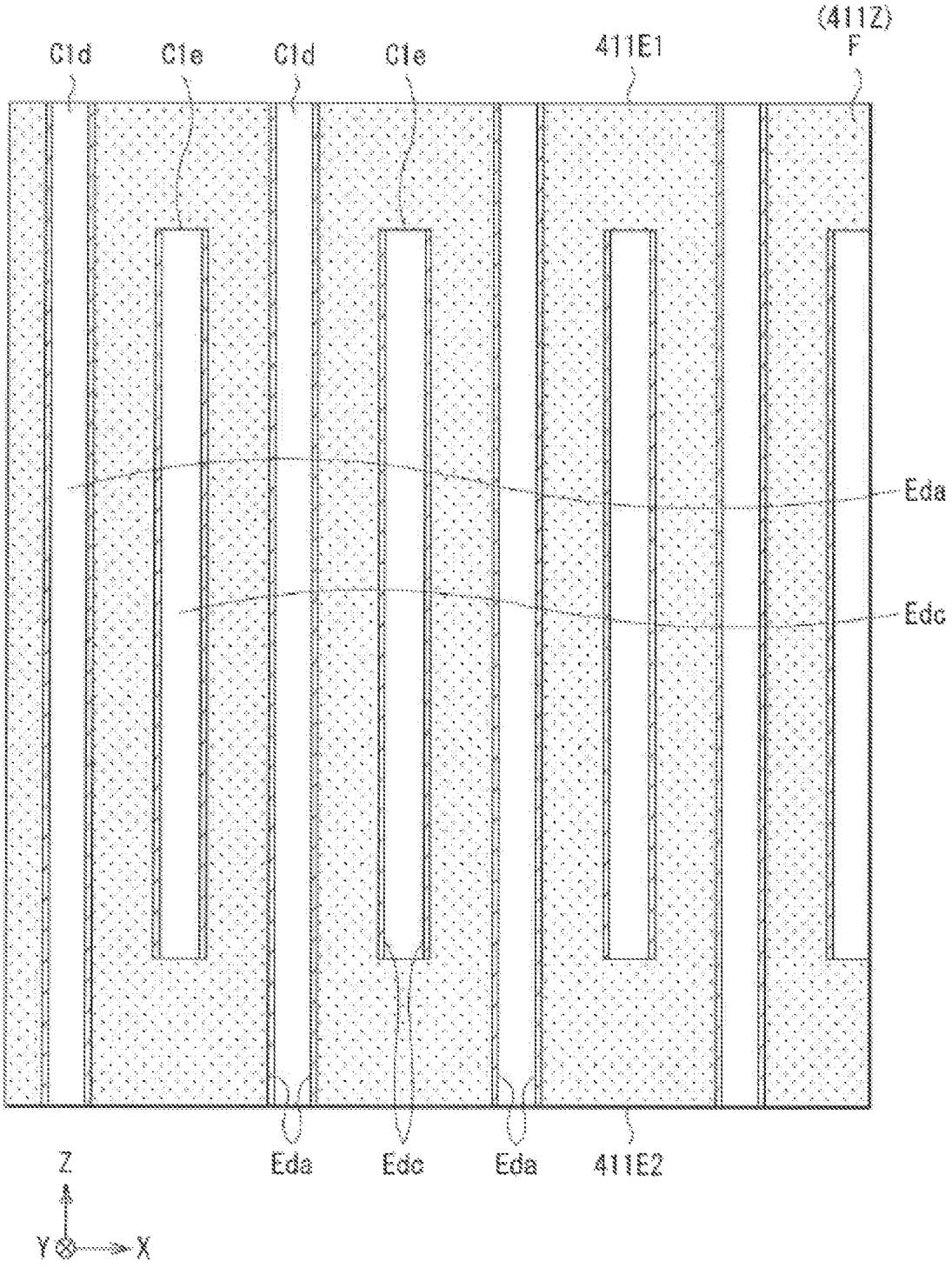
FIG. 7 is a plan view for explaining a conductive film forming process shown in FIG. 6.

Subsequently, in the step S2, a thin film of an electrically conductive material such as gold (Au) is provided to the surface of the piezoelectric substrate 411Z and the inner side surfaces of the grooves C1 using an oblique evaporation method. Thus, the drive electrodes Ed on the inner side surfaces of the grooves C1, and a conductive film F on the surface of the piezoelectric substrate 411Z are formed. The conductive film F forms the common electrode pads Pc and the active electrode pads Pa in the inkjet head chip 41. As shown in FIG. 7, the conductive film F is formed throughout the entire surface of the piezoelectric substrate 411Z including areas between the ejection grooves C1*e* and the non-ejection grooves C d adjacent to each other. The conductive film F and the drive electrodes Ed inside the grooves C1 are continuous with each other, and an electrically conductive state is ensured therebetween.

Subsequently, in the step S3, the laser processing is performed on the surface of the piezoelectric substrate 411Z provided with the conductive film F to thereby form laser processing areas LA in the portions between the ejection grooves C1*e* and the non-ejection grooves C1*d* in the surface of the piezoelectric substrate 411Z. The formation of the laser processing areas LA will be described later in detail.

Further, in the step S4, surface removal processing is performed on the surface of the piezoelectric substrate 411Z on which the laser processing areas LA are formed. Specifically, the surface of the piezoelectric substrate 411Z is cut so as to form grooves in a direction crossing the direction (perpendicular to the groove extending direction) in which the laser processing areas LA extend using a dicer. In the first embodiment, there are formed a first surface removal area RA which includes a start point Ps when performing irradiation with the laser, and extends in a direction (the X direction) perpendicular to the groove extending direction, and a second surface removal area RB which includes an end point Pe when performing the irradiation with the laser, and extends in a direction perpendicular to the groove extending direction. In the surface removal areas RA, RB, the conductive film F is removed. The formation of the surface removal areas RA, RB can be achieved by grinding, milling, or the like besides cutting with the dicer.

Figure 10:
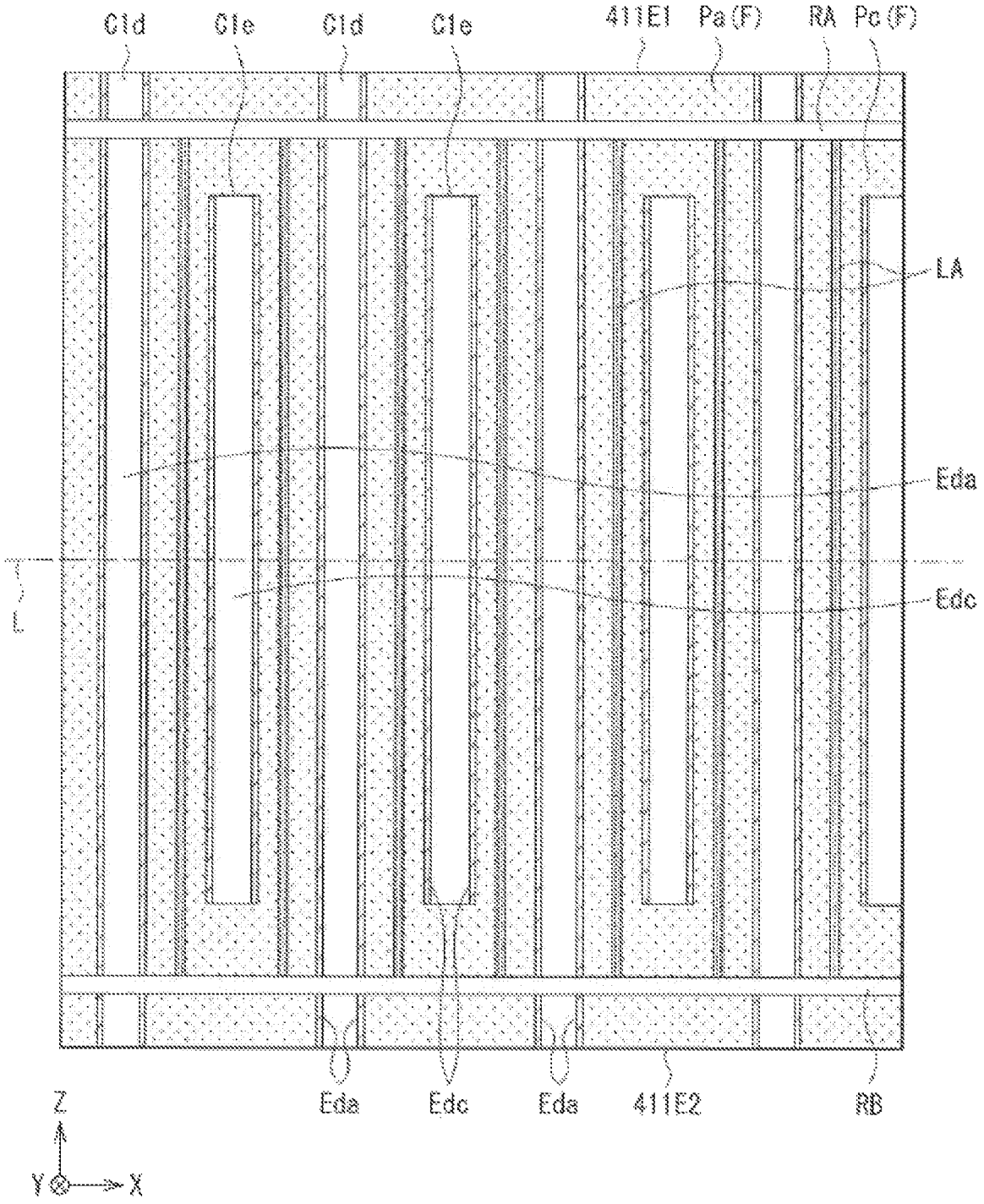
FIG. 10 is a plan view for explaining a piezoelectric substrate cutting process shown in FIG. 6.

In the step S5, the piezoelectric substrate 411Z provided with the laser processing areas LA and the surface removal areas RA, RB is cut at a predetermined position (cutting line L) between the end part 411E1 and the end part 411E2. Thus, as shown in FIG. 10, the end part 411E3 is formed along the cutting line L, and two actuator plates 411 are formed.

After completing the actuator plate 411 in such a manner, in the step S6, the actuator plate 411 and other plates (e.g., the cover plate 410 and the nozzle plate 412) are assembled with each other to complete the inkjet head 4 shown in FIG. 2 through FIG. 5, and so on.

[Formation of Laser Processing Areas]

Figure 8:
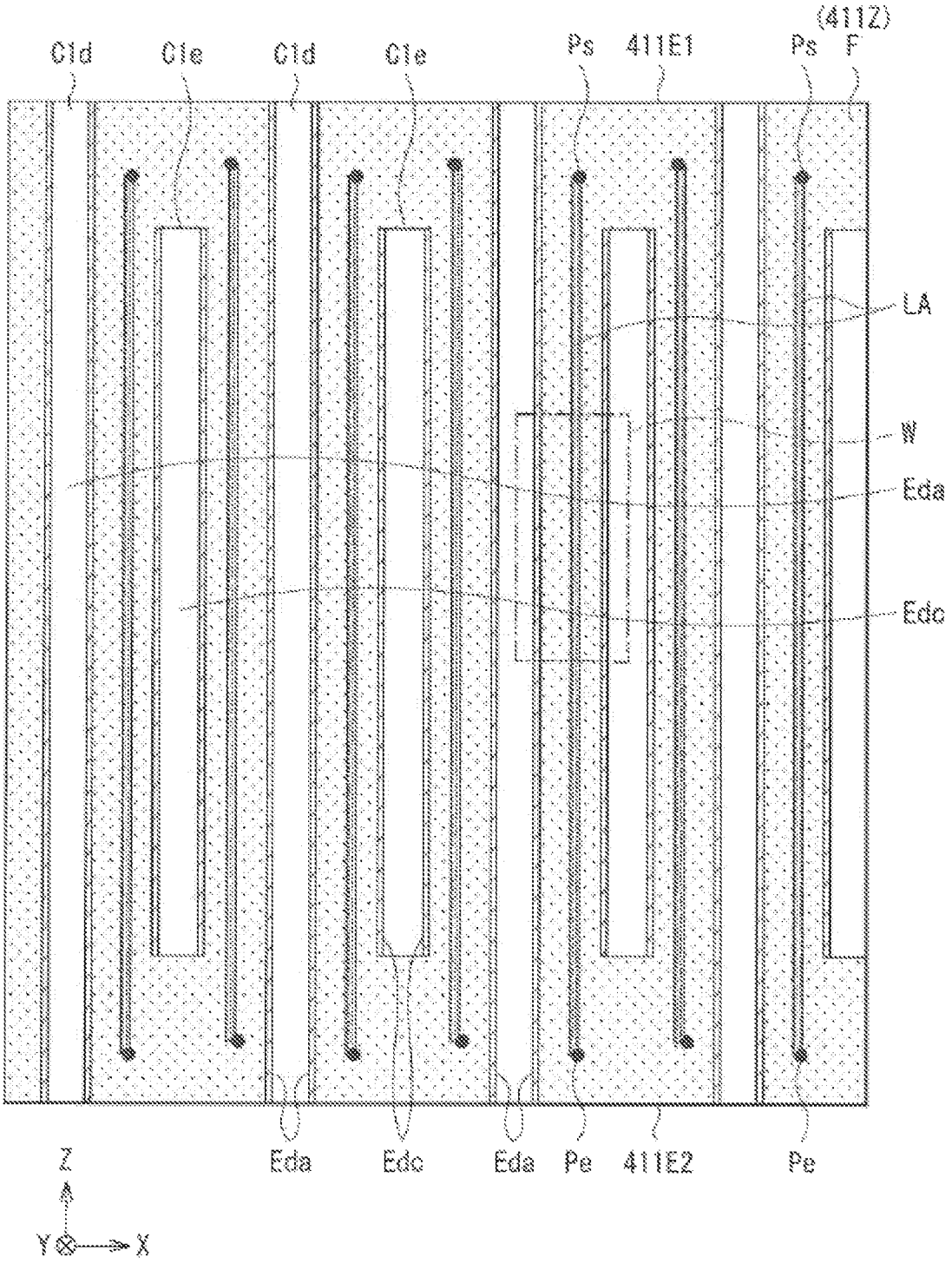
FIG. 8 is a plan view for explaining a laser processing process shown in FIG. 6.

In the laser processing process, as shown in FIG. 8, the conductive film F between the ejection groove C1*e* and the non-ejection groove C1*d* adjacent to each other is irradiated with the laser to remove the conductive film F to thereby form the laser processing areas LA where the surface of the piezoelectric substrate 411Z is exposed. In the first embodiment, the laser processing areas LA are formed in all of the areas sandwiched between the ejection groove C1*e* and the non-ejection groove C1*d*. The area from the start point Ps close to the end part 411E1 to the end point Pe set in the middle of the path toward the end part 411E2 is linearly irradiated with the laser in the groove extending direction (the Z direction). In such a manner, the laser processing areas LA each having a linear shape parallel to the groove extending direction in which the grooves C1 extend are formed on the surface of the piezoelectric substrate 411Z. In the first embodiment, the start point Ps and the end point Pe when performing the irradiation with the laser are both set at the positions closer to the end parts 411E1, 411E2 than the ejection grooves C1*e*, and thus, there are formed the laser processing areas LA longer than the ejection grooves C1*e*.

In the first embodiment, ultraviolet light, for example, ultraviolet light with the wavelength of 266 nm, is adopted for the laser processing. By adopting the ultraviolet light, it is easier to evaporate the electrically conductive material (e.g., gold (Au)) constituting the conductive film F compared to when performing the irradiation with light longer in wavelength. Therefore, it becomes possible to suppress the height of the debris (the residue) deposited due to the irradiation with the laser to a lower level.

Figure 11:
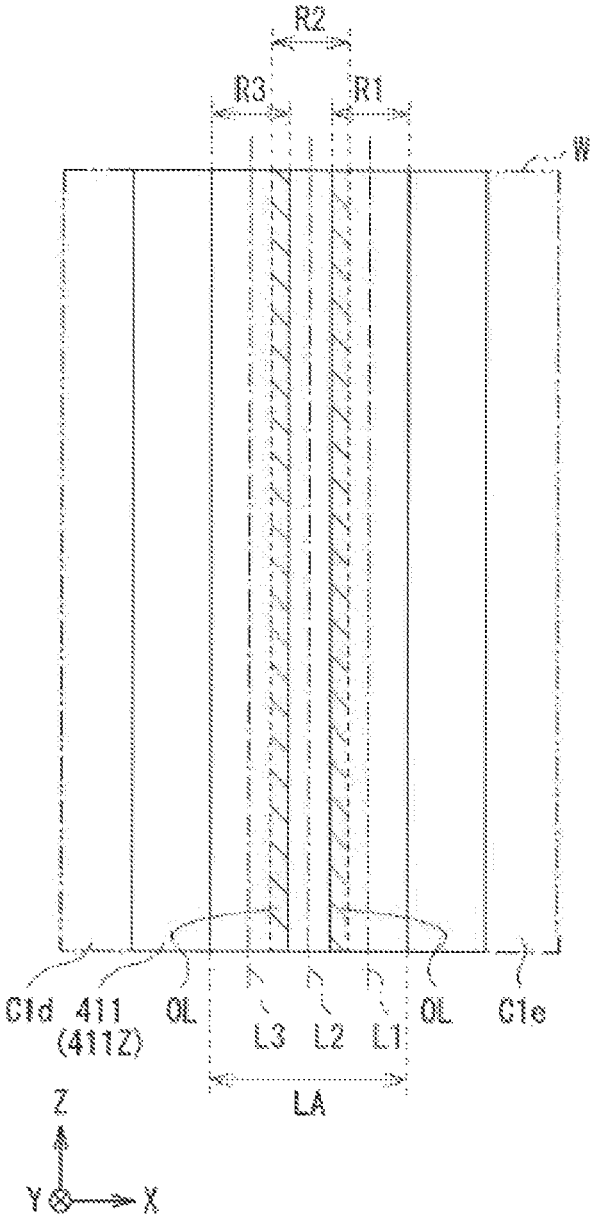
FIG. 11 is a plan view schematically showing a laser processing area provided to the actuator plate related to a first embodiment of the present disclosure.

FIG. 11 is an enlarged view of an area W indicated by the frame of the dashed-two dotted lines in FIG. 8, and schematically shows the laser processing areas LA provided to the actuator plate 411 related to the first embodiment.

In the first embodiment, as lines along which scanning with the laser is performed when performing the irradiation with the laser, there is set a plurality of laser processing lines L1, L2, and L3 extending in the groove extending direction. Thus, in the first embodiment, there are formed the laser processing areas LA each larger in width than what is formed when irradiation with the laser is performed along a single laser processing line. Further, in the first embodiment, irradiation with the laser is performed a plurality of times (e.g., twice) for each of the laser processing lines L1 through L3.

In addition to the above, in the first embodiment, irradiation ranges R1, R2, and R3 with the laser are made to overlap each other in a predetermined range OL between the two laser processing lines adjacent to each other. Here, the irradiation range with the laser means a range in a central portion where certain intensity can be obtained in the range irradiated with the laser, and the conductive film F is removed in the irradiation range. In FIG. 11, the irradiation range R1 is an irradiation range with the laser which performs a scanning operation along the laser processing line L1, the irradiation range R2 is an irradiation range with the laser which performs a scanning operation along the laser processing line L2, and the irradiation range R3 is an irradiation range with the laser which performs a scanning operation along the laser processing line L3. By overlapping the irradiation ranges R1, R2, and R3 with the laser each other in the predetermined range OL, the laser processing area LA is formed continuously in the width direction, in other words, a direction perpendicular to the direction of the scanning operation with the laser.

Figure 12:
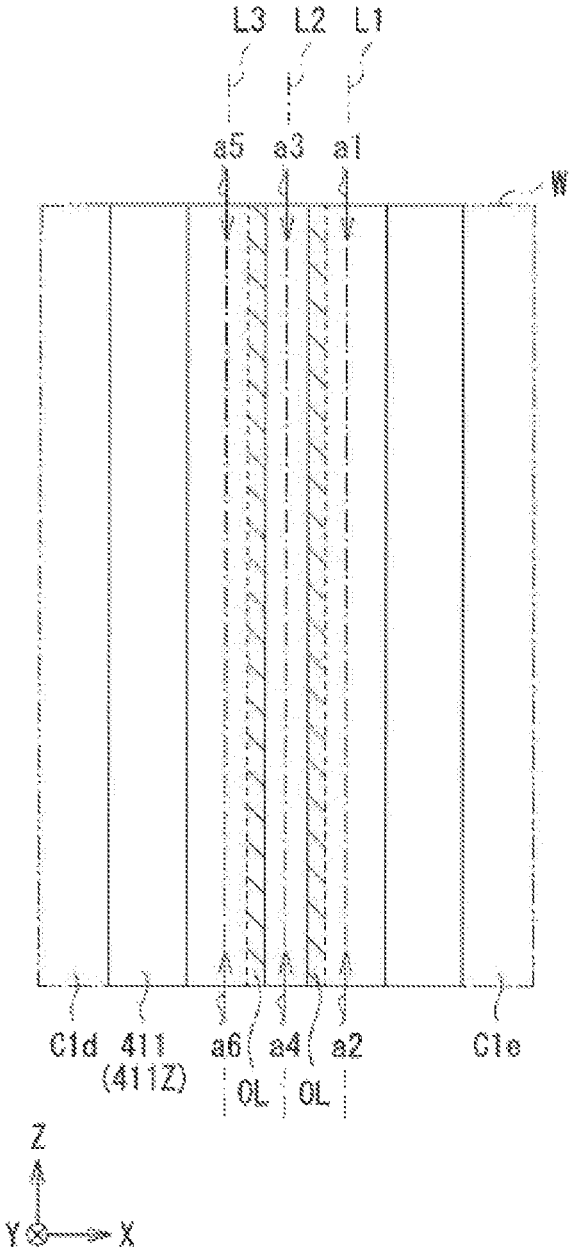
FIG. 12 is an explanatory diagram showing an example of an irradiation sequence with a laser with which the irradiation is performed when forming the laser processing area described above.

FIG. 12 through FIG. 15 show some examples of the irradiation sequence with the laser with which the irradiation is performed when forming the laser processing area LA of the actuator plate 411 related to the first embodiment. In the first embodiment, regarding the irradiation with the laser performed along the same laser processing line, a time interval is made from when the previous irradiation with the laser ends to when the subsequent irradiation with the laser starts. For example, a time interval is made after the irradiation with the laser along the laser processing line L1 shown in FIG. 12 is terminated and before the subsequent irradiation with the laser along the same laser processing line L1 is started. As is understood from the following description, the time interval is set shorter than the time necessary for the heat applied to a metal film (specifically a Ti film) by the laser processing to be released, and longer than the time in which an unexpected defect (hereinafter referred to as a "defect such as a lack" or simply as a "defect") such as a lack or a crack caused by the thermal stress applied to the piezoelectric substrate 411Z occurs.

FIG. 12 shows the irradiation sequence when the irradiation is performed while reciprocating the laser for each of the laser processing lines L through L3, and at the same time, the laser processing line used for the irradiation with the laser is sequentially changed from the ejection groove C1*e* side toward the non-ejection groove C1*d*. As described above, when doubling back the scanning with the laser to be performed along the same laser processing line, namely after terminating the irradiation with the laser in the outward path represented by the arrows a1, a3, and a5 and before starting the irradiation with the laser in the return path represented by the arrows a2, a4, and a6, there is provided a time interval.

Figure 13:
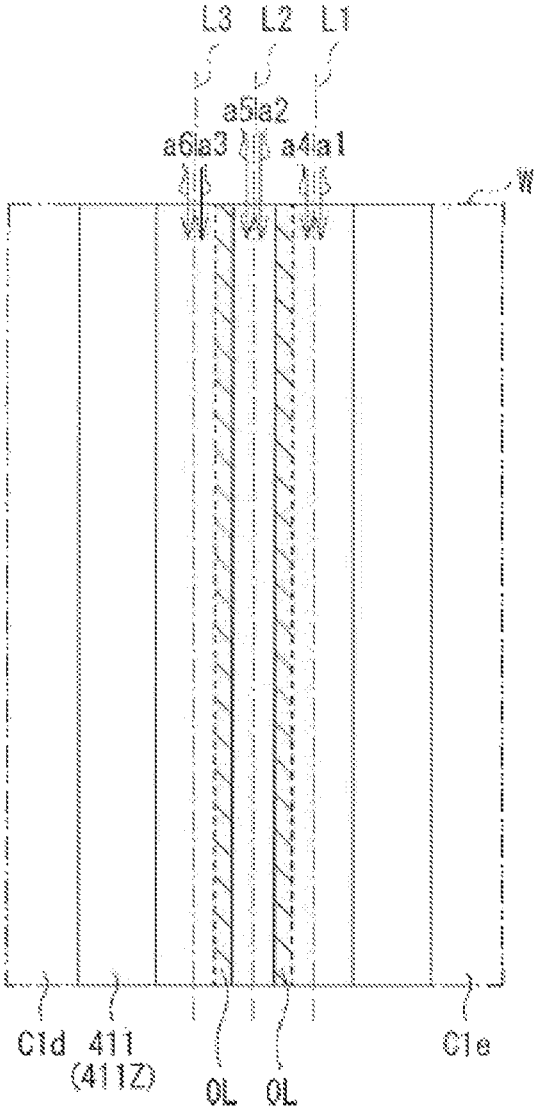
FIG. 13 is an explanatory diagram showing another example of the irradiation sequence with the laser with which the irradiation is performed when forming the laser processing area described above.

FIG. 13 shows the processing sequence when setting the scanning direction in the irradiation with the laser to a single direction (represented by the arrows a1 through a6), and at the same time, performing the irradiation with the laser along a different laser processing line between the irradiation operations with the laser performed along the same laser processing line. The direction in which the scanning with the laser is performed can be a direction from the end part 411E1 side toward the end part 411E2 (e.g., FIG. 8), or can also be a direction opposite thereto. Further, in the first embodiment, the previous irradiation with the laser is shifted from the laser processing line L1 close to the ejection groove Cle to the laser processing lines L2, L3 closer to the non-ejection groove Cid and is then performed, and after the previous irradiation with the laser along all of the laser processing lines L1 through L3 is completed, the irradiation with the laser which is performed while sequentially shifted from the laser processing line L1 close to the ejection groove C1*e* to the laser processing lines L2, L3 close to the non-ejection groove C1*d* is repeated. Here, for example, between the two irradiation operations with the laser performed along the laser processing line L1, the irradiation with the laser along the different laser processing lines L2, L3 is performed.

Figure 14:
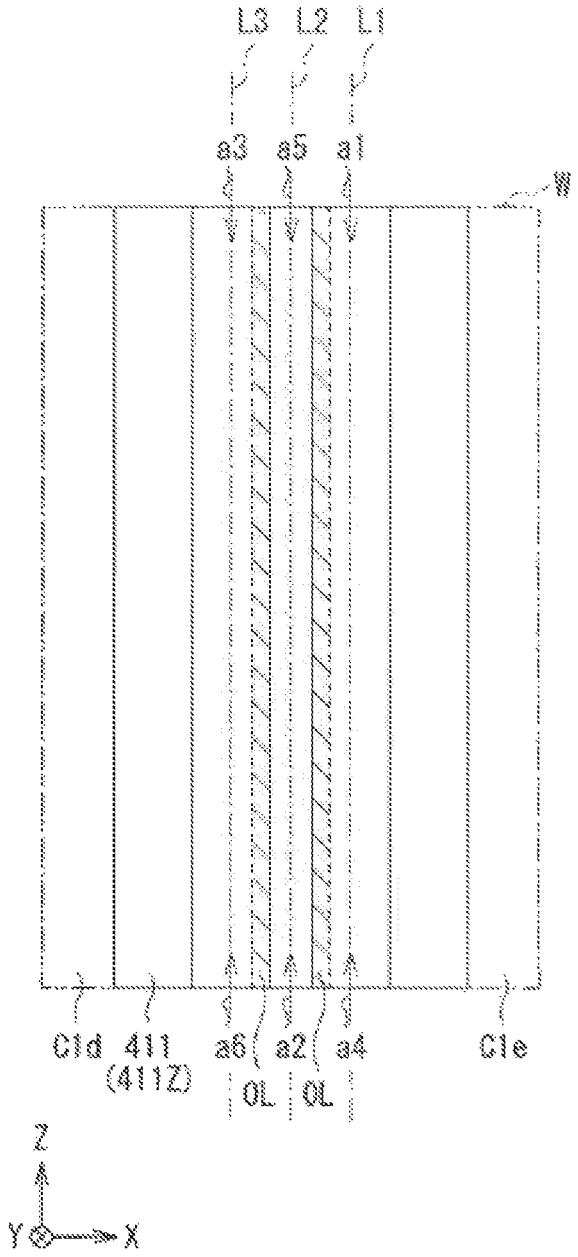
FIG. 14 is an explanatory diagram showing still another example of the irradiation sequence with the laser with which the irradiation is performed when forming the laser processing area described above.

FIG. 14 shows a processing sequence when performing the irradiation with the laser along a different laser processing line between the irradiation operations with the laser performed along the same laser processing lines similarly to the example shown in FIG. 13. It should be noted that in the example shown in FIG. 14, the previous irradiation with the laser is performed while shifted from the laser processing line L1 close to the ejection groove C1*e* to the laser processing lines L2, L3 close to the non-ejection groove C1*d*, and at the same time, the direction in which the scanning with the laser is performed in the irradiation with the laser is set to directions opposite to each other in the irradiation operations along the laser processing lines adjacent to each other. Here, for example, between the two irradiation operations with the laser performed along the laser processing line L1, the irradiation with the laser along the different laser processing lines L2, L3 is performed.

Although in the examples described hereinabove, the laser processing line in the irradiation with the laser is shifted from the laser processing line L1 close to the ejection groove C1*e* to the laser processing lines L2, L3 close to the non-ejection groove C1*d*, the sequence of shifting the laser processing lines L1 through L3 is not limited thereto, but does not matter. For example, it is possible to shift the laser processing line from the laser processing line L3 close to the non-ejection groove C1*d* to the laser processing lines L2, L1 close to the ejection groove C1*e*.

Figure 15:
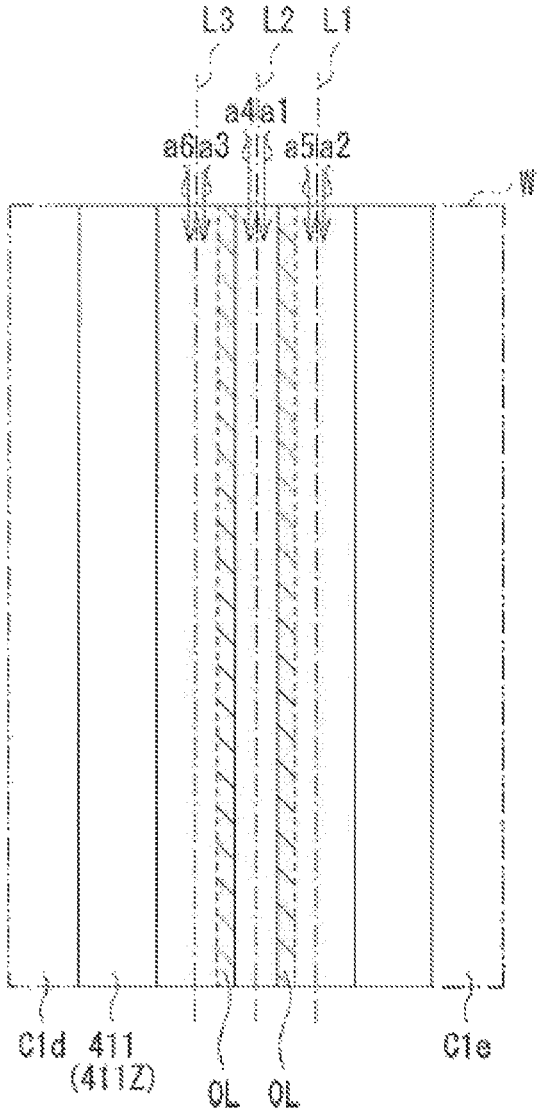
FIG. 15 is an explanatory diagram showing still another example of the irradiation sequence with the laser with which the irradiation is performed when forming the laser processing area described above.

FIG. 15 shows still another example related to the irradiation sequence with the laser. In the example shown in FIG. 15, the irradiation with the laser is performed along the laser processing line L2 located at the center of the laser processing lines L1 through L3, then the irradiation with the laser is performed along one of the laser processing lines L1, L3 closer to the ejection groove C1*e* or the non-ejection groove C1*d* than the center, and then the irradiation with the laser is performed along the other of the laser processing lines L3, L1. Here, for example, between the two irradiation operations with the laser performed along the laser processing line L2, the irradiation with the laser along the different laser processing lines L1, L3 is performed.

[Operations]

(Operation of Printer 1)

When the printer 1 operates, the ink 9 is jetted to the recording paper P while carrying the recording paper P in the carrying direction d, and reciprocating the inkjet heads 4 in the direction crossing the carrying direction d. Thus, images are recorded on the recording paper P.

(Operation of Inkjet Heads 4)

The ink 9 is jetted to the recording paper P with the following procedure. When the drive circuit 43*b* applies the drive voltages to the active electrodes Eda of the actuator plate 411, the drive circuit 43*b* applies a corresponding voltage to the nozzle plate 412. Since the flexural deformation due to the piezoelectric thickness-shear effect occurs in the drive wall Wd, and the volume of the ejection groove C1*e* increases, the ink 9 is introduced from the ink introduction hole 410*a* into the ejection groove C1*e*. Subsequently, when the drive voltage is set to zero (0 V), and at the same time, the corresponding voltage is also set to zero (0 V), the deformation of restoring to the original state occurs in the drive wall Wd. Thus, the volume of the ejection groove C1*e* decreases to pressurize the ink 9 having been introduced into the ejection groove C1*e*, and thus, the ink 9 is jetted from the ejection groove C1*e* to the recording paper P via the jet hole H2.

[Functions and Advantages]

The inkjet head chip 41, the inkjet head 4, and the inkjet printer 2 according to the first embodiment are configured as described above. The advantages obtained by the first embodiment will hereinafter be described.

First, since the irradiation with the laser is performed along the plurality of laser processing lines L1 through L3, it becomes possible to increase the width of the laser processing area LA to ensure the sufficient distance between the common electrode Edc in the ejection groove C1*e* and the active electrode Eda in the non-ejection groove C1*d*. In the first embodiment, when the number of times of jetting of the ink 9, in other words, the number of times of driving of the actuator plate 411, increases, the separation or the breakage occurs in the protective film provided to the surface of the actuator plate 411 or the piezoelectric substrate 411Z, which progresses as the number of times of jetting further increases. With the progression of such a separation or the like, the ink 9 infiltrates into the protective film and so on, and then the ink 9 acts as a bridge to cause the short circuit between the electrodes Edc, Eda adjacent to each other in some cases. According to the present embodiment, since the sufficient distance is ensured between the electrodes Edc, Eda adjacent to each other, even when the separation or the breakage occurs in the protective film and so on, and then the separation or the breakage progresses, it is possible to prevent the ink 9, in particular water-based ink, retained in the ejection groove C1*e* from infiltrating into the protective film and so on and then reaching the electrode Eda in the non-ejection groove C1*d* to cause the short circuit between the electrodes Edc, Eda.

Further, the short circuit between the electrodes Edc, Eda can be caused not only by the ink 9 infiltrating into the protective film and so on in which the separation or the breakage occurs and acting as the bridge, but also by the ink 9 becoming in the state (e.g., a mist state) in which the ink 9 can be transmitted through the protective film and so on. According to the present embodiment, since the sufficient distance is ensured between the electrodes Edc, Eda, the ink 9 in the mist state is prevented from being transmitted through the protective film and so on to form the bridge between the electrodes Edc, Eda. Therefore, the present embodiment makes a contribution to the inhibition of the short circuit between the electrodes Edc, Eda even when neither the separation nor the breakage occurs in the protective film and so on.

Here, when performing the irradiation with the laser to be performed along the same laser processing line (e.g., the laser processing line L1) without a time interval, in removing a metal film (e.g., a Ti film) hardly causing photodecomposition, it is possible to more surely remove the metal film since the metal molecule vibration state due to the laser processing heat is easily maintained. However, on the other hand, since the irradiation range (e.g., the irradiation range R1) determined with respect to the same laser processing line is continuously affected by the heat due to the continuous irradiation with the laser, a high thermal stress is applied to the member (i.e., the piezoelectric substrate 411Z) removed at the same time as the metal film, and a defect such as a lack occurs in the piezoelectric substrate 411Z. Therefore, there is a possibility of increasing the variation in capacitance in the actuator plate 411. When the variation in capacitance is increased in such a manner, it is concerned that the ejection of the ink is made unstable. Further, by the fact itself that the defect such as a lack occurs in the piezoelectric substrate 411Z, it is also concerned that an undesigned ink infiltration path through the defect is formed, or that the adhesiveness of the adhesive or the protective film and so on with respect to the piezoelectric substrate 411Z is deteriorated. In contrast, in the first embodiment, by performing the irradiation with the laser a plurality of times for each of the laser processing lines L1 through L3, and at the same time, performing the irradiation processes with the laser along the same laser processing line at a time interval, it becomes possible to avoid the excessively high thermal stress applied to the piezoelectric substrate 411Z. Thus, since it is possible to prevent the defect such as a lack from occurring in the piezoelectric substrate 411Z, it is possible to suppress the variation in capacitance in the actuator plate 411.

Second, by performing the irradiation with the laser along a different laser processing line between the irradiation operations with the laser performed along the same laser processing line, it is possible to efficiently proceed with the processing while ensuring the time interval between the irradiation operations with the laser performed along the same laser processing line.

Further, since the more homogenous removal of the conductive film F from the surface of the piezoelectric substrate 411Z is made possible, and thus it is possible to reduce the residue remaining on the surface after the laser processing, it is possible to suppress the variation in capacitance in the actuator plate 411 to thereby improve the jet characteristics of the ink 9.

Third, by overlapping the irradiation ranges in the irradiation operations with the laser performed along the respective laser processing lines different from each other, more reliable removal of the conductive film F is made possible, and it is possible to achieve a further improvement in the processing quality by the laser. Further, since it becomes possible to form the continuous laser processing areas LA which are large in width in the direction perpendicular to the groove extending direction, it is possible to sufficiently separate the common electrode Edc and the active electrode Eda from each other via the continuous laser processing area LA described above to thereby more surely prevent the short circuit due to the ink 9 acting as a bridge from occurring between these electrodes Edc, Eda.

Second Embodiment

Figure 16:
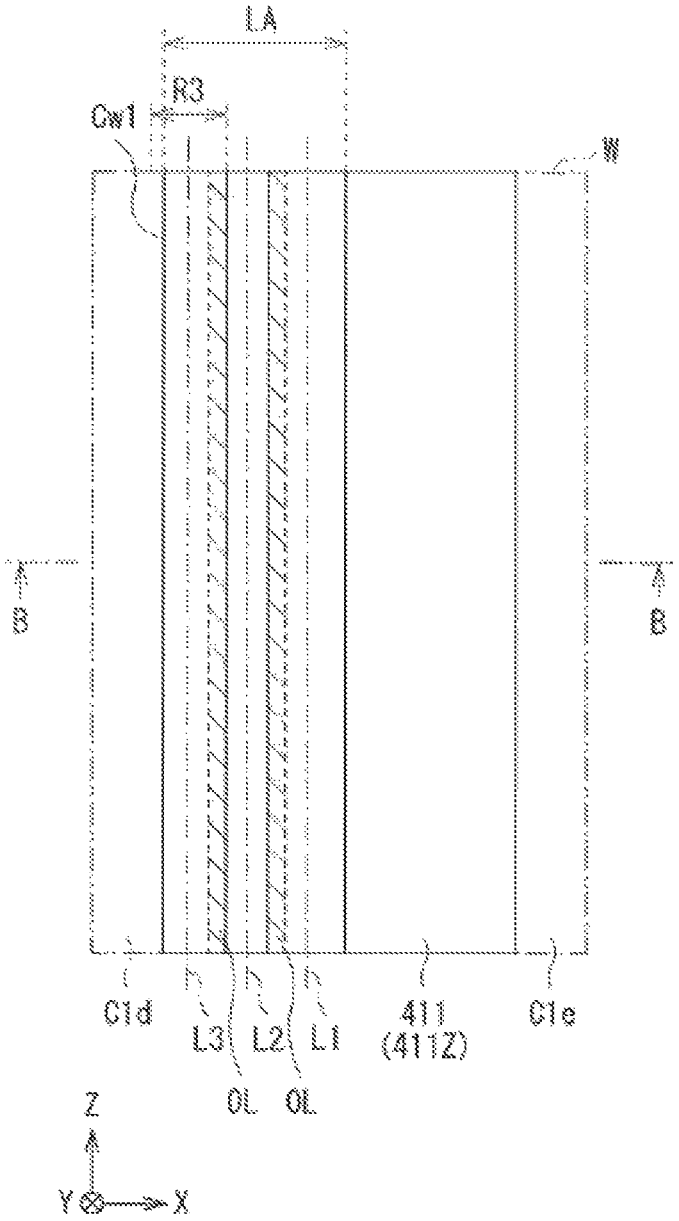
FIG. 16 is a plan view schematically showing a laser processing area provided to an actuator plate related to a second embodiment of the present disclosure.
Figure 17A:
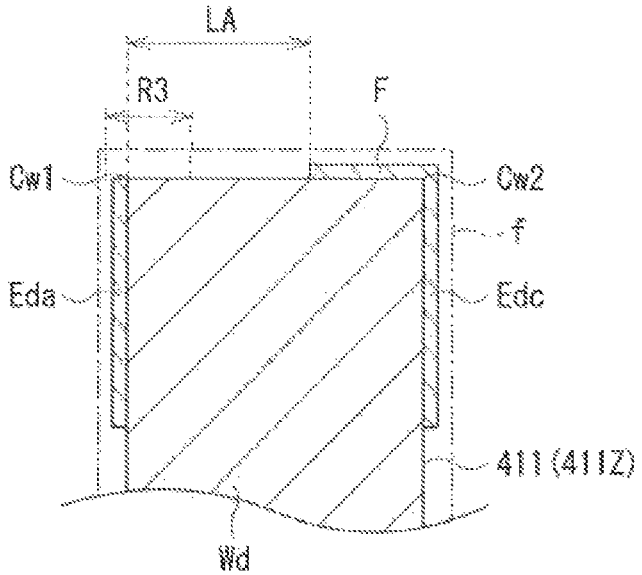
FIGS. 17A and 17B are each an enlarged cross-sectional view showing a configuration in the vicinity of a surface of the actuator plate having the laser processing area described above.
Figure 17B:
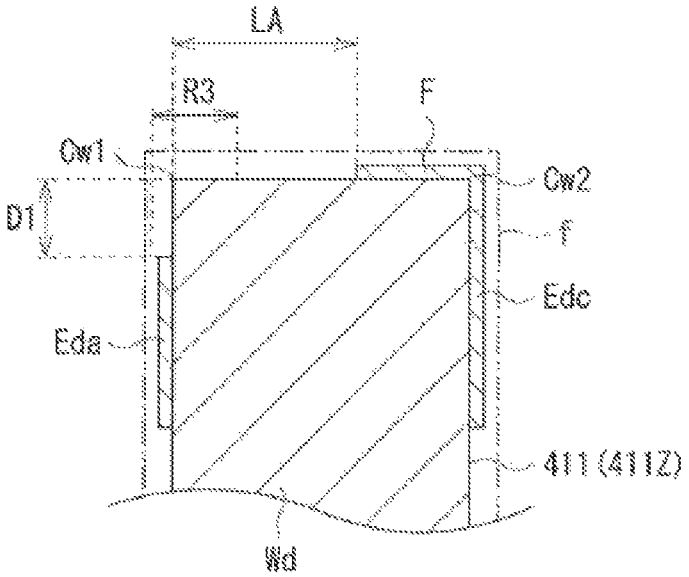

FIG. 16 is a plan view schematically showing the laser processing area LA provided to the actuator plate 411 related to a second embodiment of the present disclosure. FIGS. 17A and 17B are each a cross-sectional view of the actuator plate 411 (the piezoelectric substrate 411Z) shown in FIG. 16 along the line B-B in FIG. 16, and shows a configuration in the vicinity of the surface of the actuator plate 411 having the laser processing area LA in an enlarged manner.

In the second embodiment, when forming the laser processing areas LA, the irradiation with the laser is performed along the plurality of laser processing lines L1 through L3 extending in parallel to each other in the groove extending direction (the Z direction) to thereby form the laser processing area LA large in width, and at the same time, the irradiation range irradiated with the laser along at least one of the laser processing lines L1 through L3 is made to include a corner part of the piezoelectric substrate 411Z close to the non-ejection groove C1*d*, in other words, a corner part Cw1 of the drive wall Wd (FIGS. 17A and 17B) defining the non-ejection groove C1*d*.

Specifically, the three laser processing lines L1 through L3 are set, and at the same time, the corner part Cw1 of the drive wall Wd defining the non-ejection groove C1*d* is made to be included in the irradiation range R3 irradiated with the laser along the laser processing line L3 the closest to the non-ejection groove C1*d* of the three laser processing lines L1 through L3 to thereby expose the corner part Cw1 of the drive wall Wd from the conductive film F as shown in FIG. 17A.

Further, although the point that the irradiation ranges with the laser in the different laser processing lines are made to overlap each other, the irradiation sequence when performing the irradiation with the laser, and so on are substantially the same as those in the embodiment described above, in the second embodiment, the laser processing line L3 which defines the irradiation range with the laser including the corner part Cw1 of the drive wall Wd is set as the laser processing line along which the last irradiation operation with the laser is performed out of the plurality of laser processing lines L1 through L3 used for forming one laser processing area LA.

The electrically conductive material covering the drive wall Wd can not only be removed in the part covering the region corresponding to the surface of the piezoelectric substrate 411Z and the corner part Cw1, but can also be removed continuously in a predetermined range D1 along the inner side surface terminated at the corner part Cw1 thus exposed out of the drive wall Wd as shown in FIG. 17B. In other words, the inner side surface of the piezoelectric substrate 411Z which faces the non-ejection groove C1*d*, and is terminated at the corner part Cw1 is exposed throughout the predetermined range D1 starting at the corner part Cw1.

As described above, according to the second embodiment, by making the corner part Cw1 of the piezoelectric substrate 411Z close to the non-ejection groove C1*d* be included in the irradiation range R3 irradiated with the laser along the laser processing line L3 as at least one of the laser processing lines L1 through L3, the surface of the piezoelectric substrate 411Z is exposed in the laser processing area LA including the corner part Cw1. Therefore, it is possible to enhance the adhesiveness of the adhesive or the protective film f disposed on the surface with respect to the piezoelectric substrate 411Z to prevent the separation starting from the corner part Cw1 from occurring in the protective film f and so on to thereby prevent the ink 9 from infiltrating into the protective film f and so on.

Further, by ending with the irradiation with the laser including the corner part Cw1, it becomes possible to prevent the residue (the debris) of the electrically conductive material from remaining at the corner part Cw1 and on the surface of the substrate in the vicinity of the corner part Cw1 to thereby cleanly expose the surface of the substrate. Therefore, it is possible to further enhance the adhesiveness of the adhesive or the protective film f disposed on the surface of the corner part Cw1 to thereby more surely prevent the infiltration of the ink 9.

Further, by exposing the inner side surface of the piezoelectric substrate 411Z which faces the non-ejection groove C1*d* and is terminated at the corner part Cw1 throughout the predetermined range D1 starting at the corner part Cw1, it becomes possible to cover the corner part Cw1 with the adhesive or the protective film f. Therefore, it is possible to further enhance the adhesiveness of the protective film f and so on with respect to the surface of the substrate to thereby more surely prevent the infiltration of the ink 9.

Figure 18:
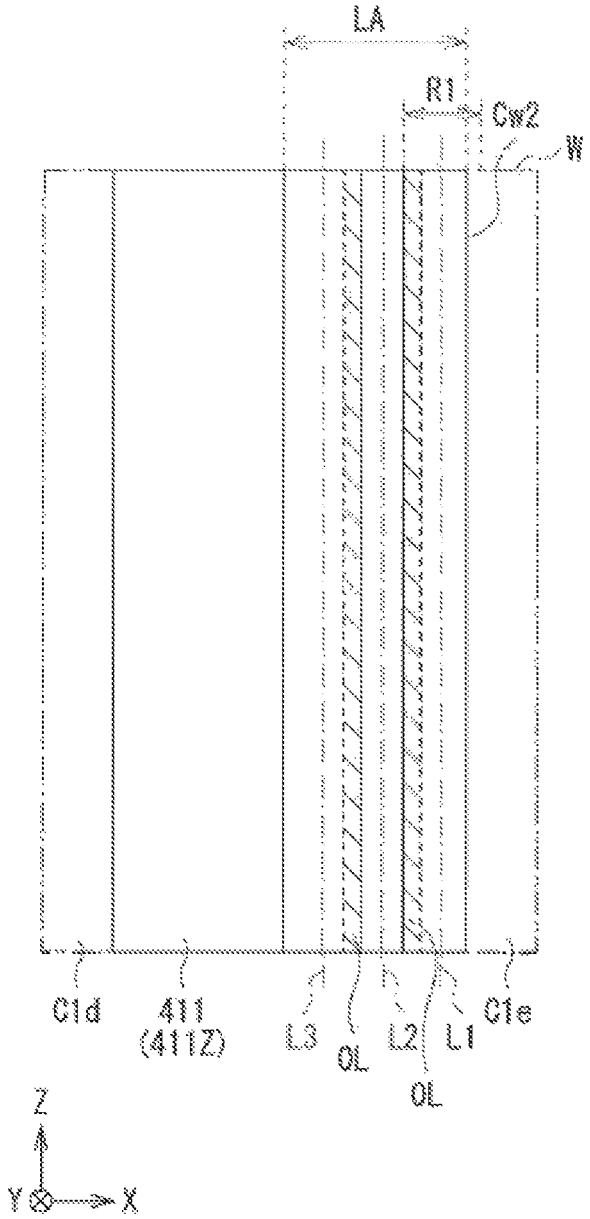
FIG. 18 is a plan view schematically showing a modified example of a laser processing area provided to the actuator plate related to the second embodiment of the present disclosure.

FIG. 18 is a plan view schematically showing a modified example of the laser processing area LA provided to the actuator plate 411 related to the second embodiment. As described above, in the example shown in FIG. 18, when forming the laser processing areas LA, the irradiation with the laser is performed along the plurality of laser processing lines L1 through L3 extending in parallel to each other in the groove extending direction (the Z direction) to thereby form the laser processing area LA large in width, and at the same time, the irradiation range R1 irradiated with the laser along at least one laser processing line (the laser processing line L1 in this modified example) out of the plurality of laser processing lines L1 through L3 is made to include a corner part of the piezoelectric substrate 411Z close to the ejection groove C1*e*, in other words, a corner part Cw2 of the drive wall Wd defining the ejection groove C1*e*.

The number of the laser processing lines used when forming the laser processing area LA is not limited to three, but can be larger (e.g., four), or can also be smaller (e.g., one).

Third Embodiment

Figure 19:
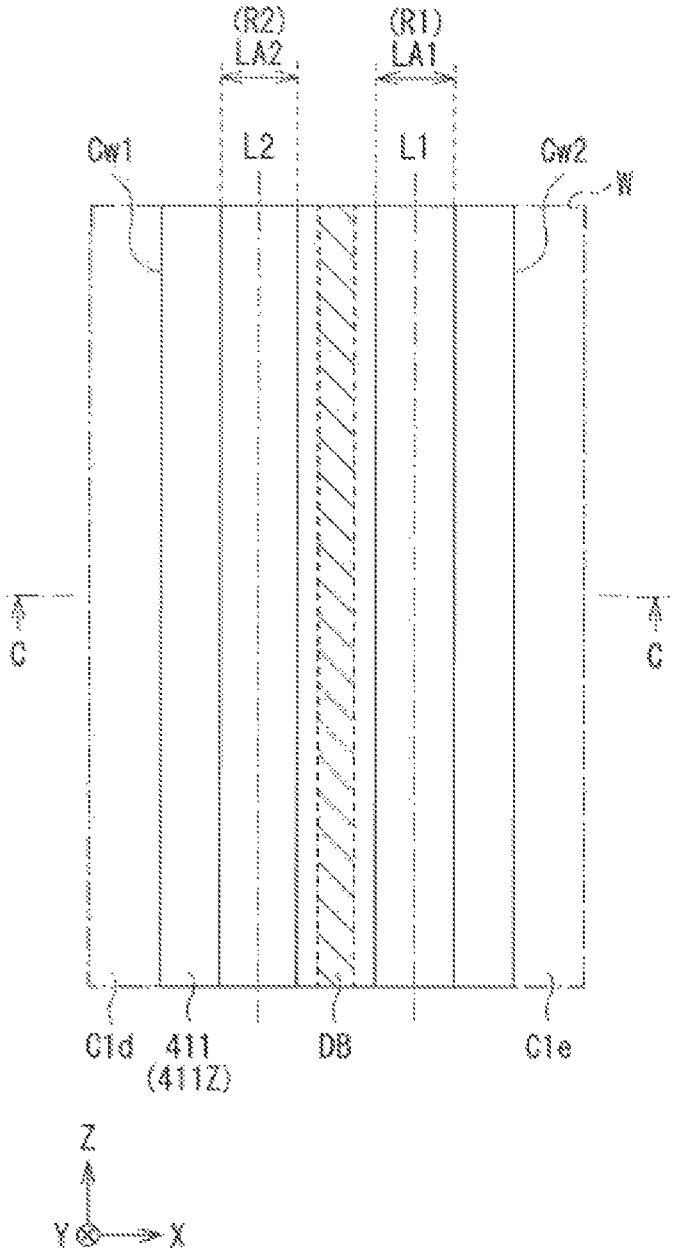
FIG. 19 is a plan view schematically showing a laser processing area provided to an actuator plate related to a third embodiment of the present disclosure.

FIG. 19 is a plan view schematically showing laser processing areas LA1, LA2 provided to the actuator plate 411 related to a third embodiment of the present disclosure.

In the third embodiment, when forming the laser processing areas LA (LA1, LA2), a plurality of irradiation operations with the laser are performed so as to provide a distance in a direction perpendicular to the laser processing lines L1, L2 between the irradiation range R1 with the laser along the first processing line L1 and the irradiation range R2 with the laser along the second processing line L2 different from the first processing line L1 out of the plurality of laser processing lines L1, L2. Thus, a deposition section DB where the residue after the irradiation with the laser is deposited is formed between the surface (corresponding to a "first surface," and hereinafter referred to as a "first laser processing area") LA1 of the piezoelectric substrate 411Z exposed by the irradiation with the laser along the first processing line L1, and the surface (corresponding to a "second surface," and hereinafter referred to as a "second laser processing area") LA2 of the piezoelectric substrate 411Z exposed by the irradiation with the laser along the second processing line L2.

Here, the irradiation sequence when performing the irradiation with the laser, the point that the time interval is made from the termination of the previous irradiation to the start of the subsequent irradiation when performing the irradiation with the laser along the same laser processing lines L1, L2, and so on is substantially the same as those in the embodiments described above. In the third embodiment, the irradiation with the laser along the two laser processing lines L1, L2 is performed, and in the irradiation sequence with the laser, for example, the irradiation with the laser is performed along the first processing line L1, then the irradiation with the laser is performed along the second processing line L2, and then the irradiation with the laser along the first processing line L1 and the subsequent irradiation with the laser along the second processing line L2 are further repeated.

Figure 20:
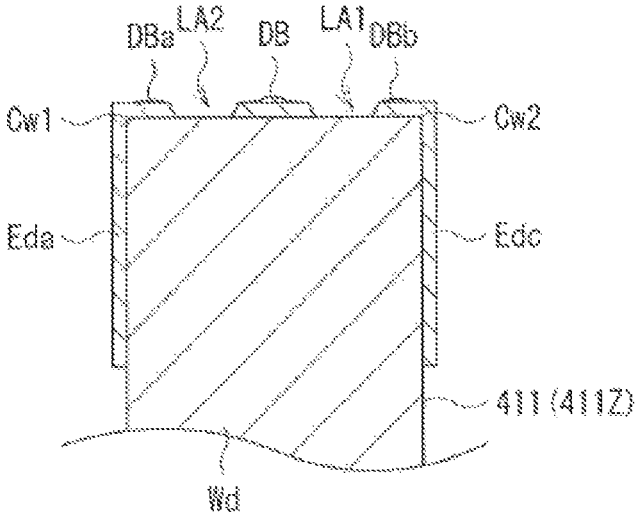
FIG. 20 is a cross-sectional view of the actuator plate (the laser processing area) shown in FIG. 19 along the line B-B shown in the drawing, and shows a configuration of a deposition section of a residue.

FIG. 20 is a cross-section view of the piezoelectric substrate 411Z shown in FIG. 19 along the line C-C in FIG. 19, and schematically shows the condition in which the deposition section DB of the residue is formed. As described above, in the third embodiment, there is formed the deposition section DB which is higher than the residues DBa, DBb remaining on the conductive film F closer to the grooves C1 (the ejection groove C1*e*, the non-ejection groove C1*d*) than the laser processing areas LA1, LA2.

According to the third embodiment, by forming the deposition section DB where the residue (i.e., the debris) after the irradiation with the laser is deposited between the exposed surface (the first laser processing area LA1) of the piezoelectric substrate 411Z along the first processing line L1 and the exposed surface (the second laser processing area LA2) of the piezoelectric substrate 411Z along the second processing line L2, it becomes possible to hinder migration of the liquid straddling the laser processing areas LA1, LA2. Therefore, it is possible to hinder the infiltration of the liquid to thereby achieve an improvement in resistance to the liquid.

Some primary concepts which can be extracted from the above description will hereinafter be summarized.

<1> A method of manufacturing a head chip which has an actuator plate, and is adapted to apply pressure to a liquid with the actuator plate so as to jet the liquid, the method comprising: manufacturing the actuator plate; and joining a nozzle plate having a jet hole for the liquid to a surface of the actuator plate, wherein the manufacturing the actuator plate includes preparing a piezoelectric substrate which has one end and another end at an opposite side to the one end, and has a first groove extending in a groove extending direction from the one end side toward the other end, and communicated with the jet hole, and a second groove extending in the groove extending direction at least at one side of the first groove in a direction crossing the groove extending direction, providing a conductive film to a surface of the piezoelectric substrate, and performing laser processing in the groove extending direction on the conductive film between the first groove and the second groove so as to form a laser processing area where the conductive film is removed to the surface of the piezoelectric substrate between the first groove and the second groove, and in the forming the laser processing area, an irradiation operation with a laser is performed along a plurality of laser processing lines extending in the groove extending direction, and the irradiation operation with the laser is performed a plurality of times for each of the laser processing lines, and the irradiation operations with the laser performed along the same laser processing line of the plurality of laser processing lines are performed at a time interval from when ending a previous irradiation operation with the laser to when starting a subsequent irradiation operation with the laser.

<2> The method of manufacturing the head chip according to <1>, wherein in the forming the laser processing area, between the irradiation operations with the laser performed along the same laser processing line, the irradiation operation with the laser along a different laser processing line is performed.

<3> The method of manufacturing the head chip according to <1> or <2>, wherein in the forming the laser processing area, irradiation ranges irradiated with the laser along the respective laser processing lines different from each other overlap each other.

<4> The method of manufacturing the head chip according to any one of <1> to <3>, wherein in the forming the laser processing area, an irradiation range irradiated with the laser along at least one of the laser processing lines includes a corner part of the piezoelectric substrate close to one of the first groove and the second groove.

<5> The method of manufacturing the head chip according to <4>, wherein the laser processing line which defines the irradiation range with the laser including the corner part is the laser processing line along which last one of the irradiation operations with the laser is performed of the plurality of laser processing lines.

<6> The method of manufacturing the head chip according to <5>, wherein in the forming the laser processing area, an inner side surface of the piezoelectric substrate which faces one of the first groove and the second groove, and is terminated at the corner part is exposed in a predetermined range from the corner part.

<7> The method of manufacturing the head chip according to any one of <1> to <6>, wherein in the forming the laser processing area, the plurality of irradiation operations with the laser are performed so as to provide a distance between the irradiation range with the laser along a first processing line and the irradiation range with the laser along a second processing line different from the first processing line of the plurality of laser processing lines, and a deposition section where a residue after the irradiation operation with the laser is deposited is formed between a first surface of the piezoelectric substrate exposed by the irradiation operation with the laser along the first processing line and a second surface of the piezoelectric substrate exposed by the irradiation operation with the laser along the second processing line.

<8> A method of manufacturing a head chip which has an actuator plate, and is adapted to apply pressure to a liquid with the actuator plate so as to jet the liquid, the method comprising: manufacturing the actuator plate, and joining a nozzle plate having a jet hole for the liquid to a surface of the actuator plate, wherein the manufacturing the actuator plate includes preparing a piezoelectric substrate which has one end and another end at an opposite side to the one end, and has a first groove extending in a groove extending direction from the one end side toward the other end, and communicated with the jet hole, and a second groove extending in the groove extending direction at least at one side of the first groove in a direction crossing the groove extending direction, providing a conductive film to a surface of the piezoelectric substrate, and performing laser processing in the groove extending direction on the conductive film between the first groove and the second groove so as to form a laser processing area where the conductive film is removed to the surface of the piezoelectric substrate between the first groove and the second groove, and in the forming the laser processing area, an irradiation operation with a laser is performed along a plurality of laser processing lines extending in the groove extending direction, the plurality of irradiation operations with the laser are performed so as to provide a distance between the irradiation range with the laser along a first processing line and the irradiation range with the laser along a second processing line different from the first processing line of the plurality of laser processing lines, and a deposition section where a residue after the irradiation operation with the laser is deposited is formed between a first surface of the piezoelectric substrate exposed by the irradiation operation with the laser along the first processing line and a second surface of the piezoelectric substrate exposed by the irradiation operation with the laser along the second processing line.

<9> A head chip used in a liquid jet head comprising: an actuator plate configured to apply pressure to a liquid; and a nozzle plate which is joined to a surface of the actuator plate, and has a jet hole for the liquid to which the pressure is applied, wherein the actuator plate is provided with a piezoelectric substrate having one end and another end at an opposite side to the one end, the piezoelectric substrate has a first groove extending in a groove extending direction from the one end side toward the other end, and communicated with the jet hole, and a second groove extending in the groove extending direction at least at one side of the first groove in a direction crossing the groove extending direction, a surface of the piezoelectric substrate is exposed in a laser processing part from which a conductive film provided to the surface is removed by an irradiation operation with a laser, and which extends in the groove extending direction, and is covered with the conductive film in a part other than the laser processing part between the first groove and the second groove, the laser processing part includes a first laser processing part and a second laser processing part separated from the first laser processing part, and the surface of the piezoelectric substrate further has a deposition section where a residue after performing the irradiation operation with the laser is deposited between the first laser processing part and the second laser processing part.

What is claimed is:

1. A method of manufacturing a head chip which has an actuator plate, and is adapted to apply pressure to a liquid with the actuator plate so as to jet the liquid, the method comprising:

manufacturing the actuator plate; and joining a nozzle plate having a jet hole for the liquid to a surface of the actuator plate, wherein the manufacturing the actuator plate includes:

preparing a piezoelectric substrate which has one end and another end at an opposite side to the one end, and has a first groove extending in a groove extending direction from the one end side toward the other end, and communicated with the jet hole, and a second groove extending in the groove extending direction at least at one side of the first groove in a direction crossing the groove extending direction, providing a conductive film to a surface of the piezoelectric substrate, and performing laser processing in the groove extending direction on the conductive film between the first groove and the second groove so as to form a laser processing area where the conductive film is removed to the surface of the piezoelectric substrate between the first groove and the second groove, and in the forming the laser processing area, an irradiation operation with a laser is performed along a plurality of laser processing lines extending in the groove extending direction, and the irradiation operation with the laser is performed a plurality of times for each of the laser processing lines, and the irradiation operations with the laser performed along the same laser processing line of the plurality of laser processing lines are performed at a time interval from when ending a previous irradiation operation with the laser to when starting a subsequent irradiation operation with the laser, wherein the plurality of laser processing lines are placed between the first groove and the second groove.

2. The method of manufacturing the head chip according to claim 1, wherein in the forming the laser processing area, between the irradiation operations with the laser performed along the same laser processing line, the irradiation operation with the laser along a different laser processing line is performed.

3. The method of manufacturing the head chip according to claim 1, wherein in the forming the laser processing area, irradiation ranges irradiated with the laser along the respective laser processing lines different from each other overlap each other.

4. The method of manufacturing the head chip according to any one of claim 1, wherein in the forming the laser processing area, an irradiation range irradiated with the laser along at least one of the laser processing lines includes a corner part of the piezoelectric substrate close to one of the first groove and the second groove.

5. The method of manufacturing the head chip according to claim 4, wherein the laser processing line which defines the irradiation range with the laser including the corner part is the laser processing line along which last one of the irradiation operations with the laser is performed of the plurality of laser processing lines.

6. The method of manufacturing the head chip according to claim 5, wherein in the forming the laser processing area, an inner side surface of the piezoelectric substrate which faces one of the first groove and the second groove, and is terminated at the corner part is exposed in a predetermined range from the corner part.

7. The method of manufacturing the head chip according to claim 1, wherein in the forming the laser processing area, the plurality of irradiation operations with the laser are performed so as to provide a distance between the irradiation range with the laser along a first processing line and the irradiation range with the laser along a second processing line different from the first processing line of the plurality of laser processing lines, and a deposition section where a residue after the irradiation operation with the laser is deposited is formed between a first surface of the piezoelectric substrate exposed by the irradiation operation with the laser along the first processing line and a second surface of the piezoelectric substrate exposed by the irradiation operation with the laser along the second processing line.

8. A method of manufacturing a head chip which has an actuator plate, and is adapted to apply pressure to a liquid with the actuator plate so as to jet the liquid, the method comprising:

manufacturing the actuator plate; and joining a nozzle plate having a jet hole for the liquid to a surface of the actuator plate, wherein the manufacturing the actuator plate includes:

preparing a piezoelectric substrate which has one end and another end at an opposite side to the one end, and has a first groove extending in a groove extending direction from the one end side toward the other end, and communicated with the jet hole, and a second groove extending in the groove extending direction at least at one side of the first groove in a direction crossing the groove extending direction, providing a conductive film to a surface of the piezoelectric substrate, and performing laser processing in the groove extending direction on the conductive film between the first groove and the second groove so as to form a laser processing area where the conductive film is removed to the surface of the piezoelectric substrate between the first groove and the second groove, and in the forming the laser processing area, an irradiation operation with a laser is performed along a plurality of laser processing lines extending in the groove extending direction, the plurality of irradiation operations with the laser are performed so as to provide a distance between the irradiation range with the laser along a first processing line and the irradiation range with the laser along a second processing line different from the first processing line of the plurality of laser processing lines, and a deposition section where a residue after the irradiation operation with the laser is deposited is formed between a first surface of the piezoelectric substrate exposed by the irradiation operation with the laser along the first processing line and a second surface of the piezoelectric substrate exposed by the irradiation operation with the laser along the second processing line, wherein the deposition section is formed between the first groove and the second groove.

9. A head chip used in a liquid jet head comprising:

an actuator plate configured to apply pressure to a liquid; and a nozzle plate which is joined to a surface of the actuator plate, and has a jet hole for the liquid to which the pressure is applied, wherein the actuator plate is provided with a piezoelectric substrate having one end and another end at an opposite side to the one end, the piezoelectric substrate has a first groove extending in a groove extending direction from the one end side toward the other end, and communicated with the jet hole, and a second groove extending in the groove extending direction at least at one side of the first groove in a direction crossing the groove extending direction, a surface of the piezoelectric substrate is exposed in a laser processing part from which a conductive film provided to the surface is removed by an irradiation operation with a laser, and which extends in the groove extending direction, and is covered with the conductive film in a part other than the laser processing part between the first groove and the second groove, the laser processing part includes a first laser processing part and a second laser processing part separated from the first laser processing part, and the surface of the piezoelectric substrate further has a deposition section where a residue after performing the irradiation operation with the laser is deposited between the first laser processing part and the second laser processing part, wherein the deposition section is formed between the first groove and the second groove.

* * * * *